US007121248B2

(12) United States Patent
Fukuda et al.

(10) Patent No.: US 7,121,248 B2
(45) Date of Patent: Oct. 17, 2006

(54) VERTICAL ENGINE

(75) Inventors: Yoshihiko Fukuda, Saitama (JP); Hiroki Tawa, Saitama (JP); Kazuhiro Ishizaka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/852,664

(22) Filed: May 25, 2004

(65) Prior Publication Data

US 2005/0005894 A1 Jan. 13, 2005

(30) Foreign Application Priority Data

May 26, 2003 (JP) ..... 2003-147373
May 26, 2003 (JP) ..... 2003-147374

(51) Int. Cl.
*F01M 9/10* (2006.01)
*F02B 67/06* (2006.01)
*B63H 20/00* (2006.01)

(52) U.S. Cl. ..... 123/196 W; 123/196 R

(58) Field of Classification Search ..... 123/196 W, 123/196 R, 41.33, 41.38, 41.35, 41.42, 90.33
See application file for complete search history.

(56) References Cited

U.S. PATENT DOCUMENTS 4,974,561 A * 12/1990 Murasaki et al. ..... 123/90.31
5,031,591 A * 7/1991 Shinoda et al. ..... 123/196 W
5,447,127 A * 9/1995 Luck et al. ..... 123/90.31
5,669,839 A * 9/1997 Graf et al. ..... 474/91
6,336,434 B1 1/2002 Shomura et al. ..... 123/195 R
6,520,139 B1 * 2/2003 Kobayashi ..... 123/196 R
6,863,042 B1 * 3/2005 Oh ..... 123/196 R

FOREIGN PATENT DOCUMENTS

| | | |
|---|---|---|
| EP | 0 839 992 | 5/1998 |
| JP | 07-243314 | 9/1995 |
| JP | 9-41909 | 2/1997 |
| JP | 09-273408 | 10/1997 |
| JP | 2001-98951 | 4/2001 |
| JP | 2002-138810 | 5/2002 |

* cited by examiner

*Primary Examiner*—Noah P. Kamen
*Assistant Examiner*—Jason Benton
(74) *Attorney, Agent, or Firm*—Arent Fox PLLC

(57) ABSTRACT

Recesses are provided in portions of a head cover and a crankcase which are opposed to outer peripheries of a timing chain and a balancer-driving chain driven by a crankshaft of a vertical engine, whereby vertical walls and horizontal walls are formed to oppose to outer peripheral surfaces and lower surfaces of the timing chain and the balancer-driving chain. An oil scattered from the timing chain and the balancer-driving chain by a centrifugal force is caught on the vertical walls, and the oil flowing down along the vertical walls by gravitation is retained on the underlying horizontal walls, whereby the oil can be brought into contact with the chains without waste to effectively lubricate the chains.

18 Claims, 23 Drawing Sheets

UPPER SURFACE OF MOUNT CASE

LOWER SURFACE OF PUMP BODY

LOWER SURFACE OF ENGINE SUBASSEMBLY

VERTICAL ENGINE

BACKGROUND OF THE INVENTION

1. Field of the Invention

The present invention relates to a vertical engine in which a chain circulated in a generally horizontal plane is wound around sprockets mounted on first and second shafts each disposed in a generally horizontal direction.

2. Description of the Related Art

Japanese Patent Application Laid-open No. 9-41909 discloses a vertical engine in which a timing chain for transmitting a driving force from a crankshaft to a camshaft is accommodated within a chain cover covering upper surfaces of a cylinder block and a cylinder head of the engine.

Japanese Patent Application Laid-open No. 2001-98951 discloses a vertical engine for an outboard engine system in which a timing chain for transmitting a driving force from a crankshaft to a camshaft is disposed between lower surfaces of a cylinder block and a cylinder head of the engine and an upper surface of an engine holder supporting the engine.

In general, in a vertical engine including a timing chain disposed in a horizontal plane, the plane of disposition of the timing chain is perpendicular to a direction in which an oil returned to an oil pan is dropped by gravitation. For this reason, frequency of contact of the oil with the timing chain is decreased, so that it is difficult to lubricate the timing chain.

Especially, in the vertical engine described in Japanese Patent Application Laid-open No. 9-41909, the timing chain is disposed at an upper portion of the engine, however, it is not that a special lubricating device for the timing chain is mounted, and rather only an amount of the oil as much as comparable to mist is supplied to a breather chamber. Thus, there is a fear that the lubrication of the timing chain is insufficient, resulting in a reduction in durability. On the other hand, in the vertical engine described in Japanese Patent Application Laid-open No. 2001-98951, the timing chain is disposed at a lower portion of the engine and hence, the timing chain can be lubricated by the oil which has lubricated various portions of the engine and dropped into the oil pan. However, the oil cannot be entrained on the timing chain disposed in the horizontal plane as described above, and it is difficult to bring the oil into sufficient contact with the timing chain.

SUMMARY OF THE INVENTION

Accordingly, it is an object of the present invention to ensure that a chain disposed in a horizontal plane of a vertical engine can be lubricated effectively.

To achieve the above object, according to a first feature of the present invention, there is proposed a vertical engine comprising a first shaft disposed in a generally vertical direction, a second shaft disposed in a generally vertical direction and driven by the first shaft, and a chain wound around sprockets mounted on the first and second shafts and circulated in a generally horizontal plane, wherein the vertical engine further includes an oil guide means which is disposed along at least a portion of a circulation locus of the chain and which includes a generally horizontal wall opposed to a lower surface of the chain.

With the above-described arrangement, the oil guide means disposed along at least a portion of the circulation locus of the chain is provided with the generally horizontal wall opposed to the lower surface of the chain. Therefore, the oil retained on an upper surface of the horizontal wall can be deposited on the chain to effectively lubricate the chain, thereby enhancing the durability of the chain.

According to a second feature of the present invention, in addition to the first feature, the oil guide means is mounted in a region where the chain is meshed with the sprockets, and the oil guide means includes a vertical wall which rises generally vertically from the horizontal wall and which is opposed to an outer peripheral surface of the chain.

With the above-described arrangement, the oil guide means mounted in the region where the chain is meshed with the sprockets is provided with the vertical wall which rises generally vertically from the horizontal wall and is opposed to the outer peripheral surface of the chain. Therefore, the oil scattered from the sprockets or the chain by a centrifugal force can be caught on the vertical wall, and the oil flowing down along the vertical wall by gravitation can be retained on the underlying horizontal wall, whereby the oil can be brought into contact with the chain without waste to further effectively lubricate the chain.

According to a third feature of the present invention, in addition to the first feature, the first and second shafts are provided at their upper ends with the sprockets, and the oil guide means is disposed at a location along the chain meshed with the sprocket on the second shaft and above a bearing of the second shaft.

With the above-described arrangement, the oil guide means extending along the chain meshed with the sprocket mounted at the upper end of the second shaft is disposed above the bearing of the second shaft. Therefore, even when the lubrication of the chain by the oil flowing down from the bearing cannot be expected, the chain can be lubricated by the oil guide means.

According to a fourth feature of the present invention, in addition to the first feature, the first and second shafts are provided at their lower ends with the sprockets, and the oil guide means is disposed above a bottom wall of a chain chamber in which the chain is accommodated.

With the above-described arrangement, the oil guide means extending along the chain meshed with the sprocket mounted at the lower end of the second shaft is disposed above the bottom wall of the chain chamber and hence, when the oil which does not contribute to the lubrication of the chain is discharged from the bottom wall of the chain chamber, the oil guide means cannot obstruct the discharge of the oil.

According to a fifth feature of the present invention, in addition to the first feature, the oil guide means is formed integrally with a member defining a chain chamber in which the chain is accommodated.

With the above-described arrangement, the oil guide means is formed integrally with the member defining the chain chamber and hence, the number of parts and the number of assembling steps can be decreased, as compared with a case where the oil guide means is formed as a separate member.

According to a sixth feature of the present invention, in addition to the fifth feature, the oil guide means is formed by depressing a portion of the member defining the chain chamber, in which the chain is accommodated.

With the above-described arrangement, the oil guide means is formed by depressing a portion of the member defining the chain chamber, and hence a useless wall portion of the member can be decreased to contribute to a reduction in weight.

According to a seventh feature of the present invention, in addition to the first feature, the oil guide means is mounted in a member supporting the first shaft or the second shaft.

With the above-described arrangement, the oil guide means is mounted in the member supporting the first shaft or the second shaft and hence, it is possible to increase the dimensional accuracy of a clearance defined between the chain and the oil guide means.

According to an eighth feature of the present invention, there is proposed a vertical engine comprising a first shaft disposed in a generally vertical direction, a second shaft disposed in a generally vertical direction and driven by the first shaft, and a chain wound around sprockets mounted on the first and second shafts and circulated in a generally horizontal plane, wherein the vertical engine further includes an oil guide means which is disposed along a region where the chain is meshed with the sprockets, and which includes a generally vertical wall opposed to an outer peripheral surface of the chain.

With the above-described arrangement, the oil guide means disposed along the region where the chain is meshed with the sprockets is provided with the generally vertical wall opposed to the outer peripheral surface of the chain. Therefore, the oil scattered from the sprockets or the chain by a centrifugal force can be caught on the vertical wall, whereby the oil can be brought into contact with the chain without waste to further effectively lubricate the chain.

According to a ninth feature of the present invention, in addition to any of the first to eighth features, an oil jet for injecting the oil to the chain is mounted in the chain chamber in which the chain is accommodated.

With the above-described arrangement, the oil is injected to the chain by the oil jet mounted in the chain chamber in which the chain is accommodated and hence, the chain can be lubricated sufficiently, leading to an enhancement in durability of the chain.

According to a tenth feature of the present invention, in addition to any of the first to eighth features, the chain is a silent chain.

With the above-described arrangement, the chain is comprised of the silent chain, and hence noise can be reduced.

According to an eleventh feature of the present invention, there is proposed a vertical engine comprising a first shaft disposed in a generally vertical direction, a second shaft disposed in a generally vertical direction and driven by the first shaft, and a chain wound around sprockets mounted on the first and second shafts and circulated in a generally horizontal plane, wherein the vertical engine further includes a rib which is disposed generally along a travel locus of the chain to guide an oil to the chain.

With the above-described arrangement, the rib is provided generally along the travel locus of the chain which is wound around the sprockets mounted around the first and second shafts and which is circulated in the generally horizontal plane. Therefore, the chain can be lubricated effectively by guiding the oil to the chain by the rib, leading to an enhancement in durability of the chain.

According to a twelfth feature of the present invention, in addition to the eleventh feature, the rib is formed integrally on a lower surface of a cover member covering the chain from above.

With the above-described arrangement, the rib is formed integrally on the lower surface of the cover member covering the chain from above, and hence a special member for provision of the rib is not required, leading to reductions in the number of parts and the number of assembling steps.

According to a thirteenth feature of the present invention, in addition to the eleventh feature, a chain tensioner or a chain guide is disposed along the travel locus of the chain, and the rib is provided above the chain tensioner or the chain guide.

With the above-described arrangement, the rib is provided above the chain tensioner or the chain guide, and hence the oil flowing down along the rib can be supplied directly to the chain. Especially, when the chain is a chain comprising plates each having a pinhole and connected together by a pin, the oil can be supplied positively to the chain through the pinholes in the plates, thereby enhancing the durability of the chain. When the chain is a silent chain in which teeth formed on a plurality of plates are engaged with the sprockets, a driving force from each of the sprockets is applied directly to sliding portions of the holes in the plates and the pins, resulting in severe lubricating conditions. However, the chain can be lubricated by positively supplying the oil to the sliding portions, leading to an enhancement in durability of the chain.

According to a fourteenth feature of the present invention, in addition to the eleventh feature, the rib is provided sideways of the sprocket mounted on the first shaft or the second shaft.

With the above-described arrangement, the rib is provided sideways of the sprocket mounted on the first shaft or the second shaft. Therefore, the oil scattered from the sprocket by a centrifugal force can be caught on the rib and guided to the chain, whereby frequency of contact of the oil with the chain is increased to further enhance a lubricating effect.

According to a fifteenth feature of the present invention, in addition to the eleventh feature, the chain is wound around the sprockets mounted at upper ends of the first shaft and the second shaft.

With the above-described arrangement, even when it is difficult to lubricate the chain due to the reeving of the chain around the sprockets mounted at the upper ends of the first shaft and the second shaft, the chain can be lubricated effectively by the oil flowing down along the rib.

According to a sixteenth feature of the present invention, in addition to the eleventh feature, the first shaft is a crankshaft, and the second shaft is a camshaft.

With the above-described arrangement, a timing chain wound around the crankshaft and the camshaft can be lubricated effectively.

According to a seventeenth feature of the present invention, in addition to the eleventh feature, the first shaft is a crankshaft, and the second shaft is a balancer-driving shaft.

With the above-described arrangement, the balancer-driving chain wound around the crankshaft and the balancer shaft can be lubricated effectively.

According to an eighteenth feature of the present invention, in addition to any of the eleventh to seventeenth features, an oil jet for injecting the oil to the chain is mounted in a chain chamber in which the chain is accommodated.

With the above-described arrangement, the oil is injected by the oil jet mounted in the chain chamber in which the chain is accommodated. Therefore, the oil can be supplied effectively for the lubrication. Moreover, it is easy to regulate the total amount of oil injected, and hence the chain can be lubricated sufficiently, leading to an enhancement in durability of the chain.

According to a nineteenth feature of the present invention, in addition to any of the eleventh to seventeenth features, the chain is a silent chain.

With the above-described arrangement, the chain is comprised of the silent chain, and hence noise can be suppressed.

A crankshaft 13 in an embodiment corresponds to the first shaft of the present invention; a camshaft 73 and a balancer shaft 79 in the embodiment correspond to the second shaft of the present invention; a timing chain 30 and a balancer-driving chain 82 in the embodiment correspond to the chain of the present invention; a crankcase 14 and a head cover 16 in the embodiment correspond to the member defining the chain chamber of the present invention; a chain cover 31 in the embodiment corresponds to the cover member of the present invention; first, second, third and fourth ribs 31*b*, 31*c*, 31*e* and 31*f* in the embodiment correspond to the rib of the present invention; a cam-driving sprocket 72, a cam follower sprocket 74, a balancer follower sprocket 80 and a balancer-driving sprocket 81 in the embodiment correspond to the sprockets of the present invention; first, second and third oil jets 101, 103 and 105 in the embodiment correspond to the oil jet of the present invention.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment shown in the accompanying drawings.

Figure 1:
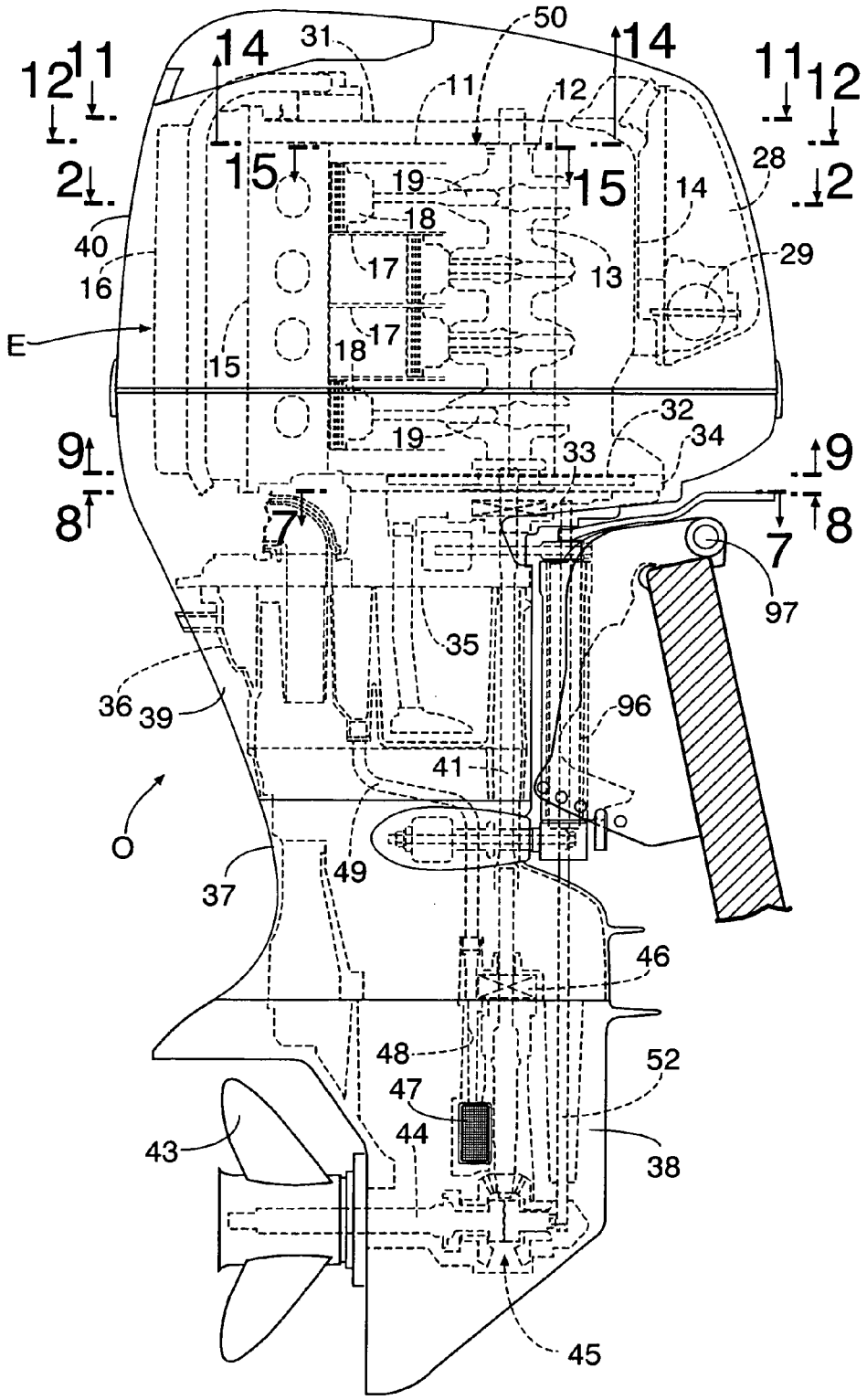
FIG. 1 is a side view of the entirety of an outboard engine system according to one embodiment of the present invention.
Figure 2:
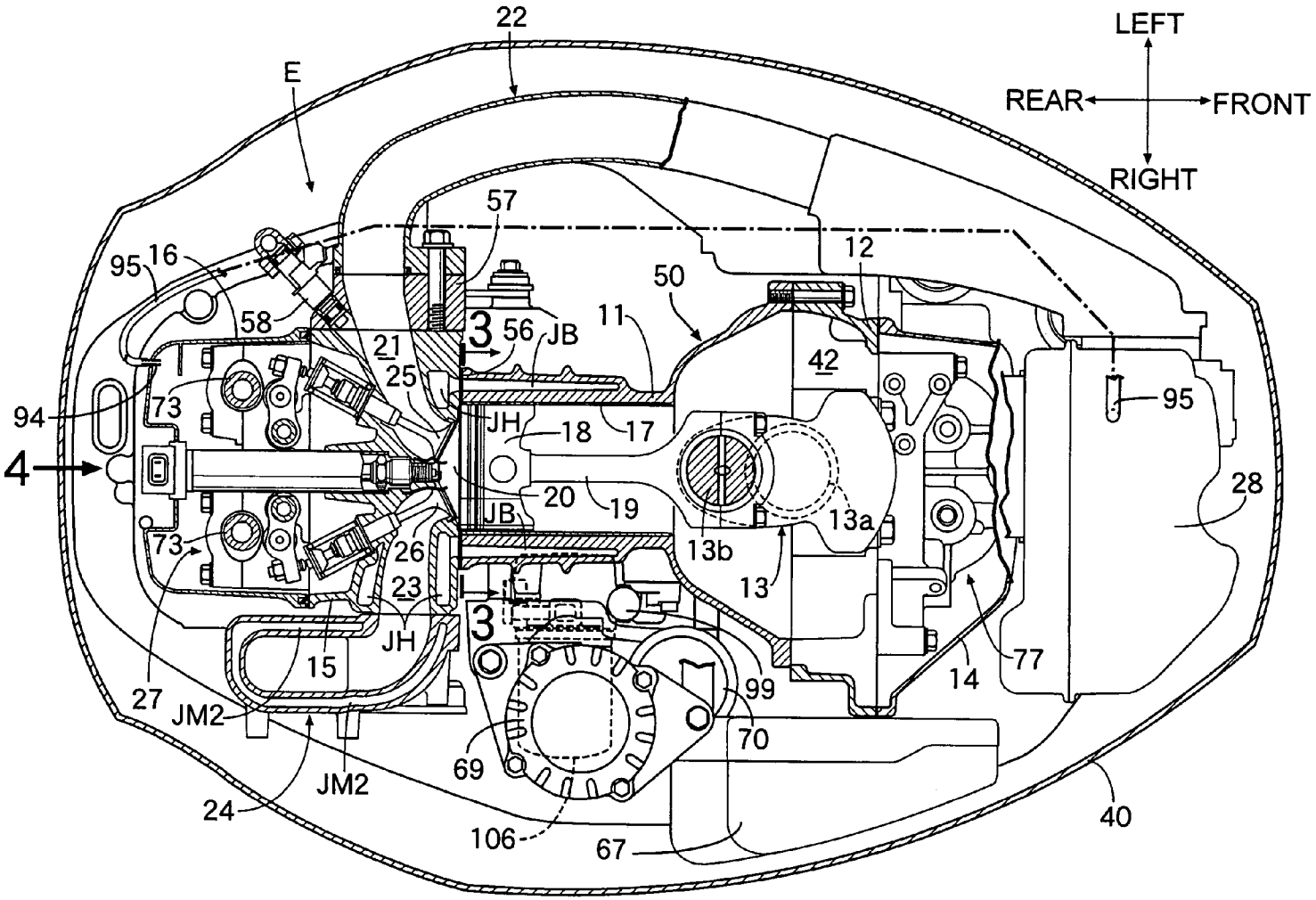
FIG. 2 is an enlarged sectional view taken along a line 2—2 in FIG. 1.
Figure 3:
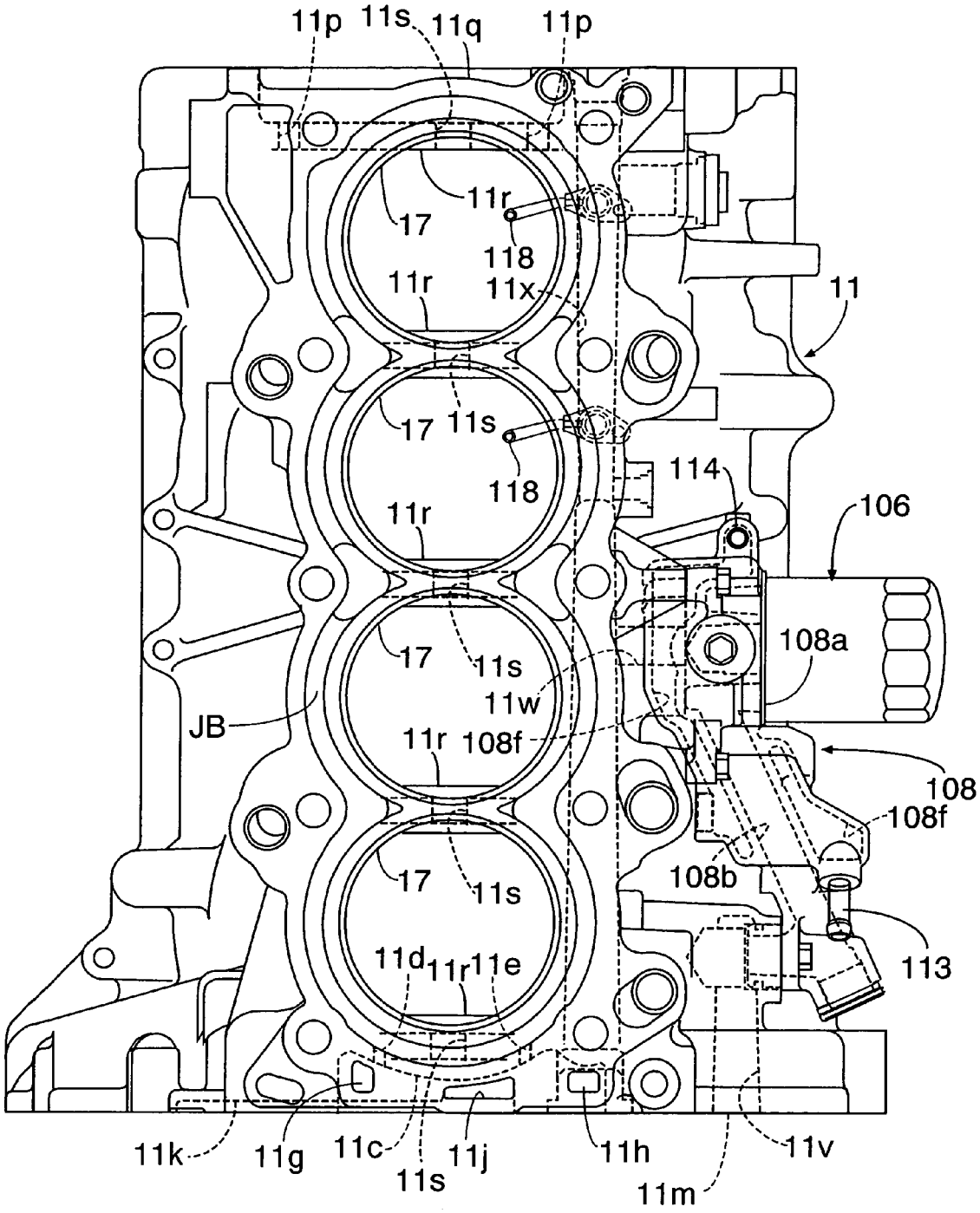
FIG. 3 is an enlarged sectional view taken along a line 3—3 in FIG. 2.

As shown in FIGS. 1 to 3, an outboard engine system O is mounted on a hull so that it can perform a steering motion in a lateral direction about a steering shaft 96 and a tiling motion in a vertical direction about a tilting shaft 97. A water-cooled vertical engine E of an in-line 4-cylinder and 4-stroke type mounted at an upper portion of the outboard engine system O includes a cylinder block 11, a lower block 12 coupled to a front surface of the cylinder block 11, a crankshaft 13 disposed in a generally vertical direction and supported so that five journals 13*a*, 13*a*, 13*a*, 13*a*, 13*a* (hereinafter referred to as 13*a* for simplification) are interposed between the cylinder block 11 and the lower block 12, a crankcase 14 coupled to a front surface of the lower block 12, a cylinder head 15 coupled to a rear surface of the cylinder block 11, and a head cover 16 coupled to a rear surface of the cylinder head 15. Four pistons 18, 18, 18, 18 (hereinafter referred to as 18 for simplification) slidably received in four sleeve-shaped cylinders 17, 17, 17, 17 (hereinafter referred to as 17 for simplification) cast in the cylinder block 11 are connected to four crankpins 13*b*, 13*b*, 13*b*, 13*b* (hereinafter referred to as 13*b* for simplification) of the crankshaft 13 through four connecting rods 19, 19, 19, 19 (hereinafter referred to as 19 for simplification), respectively.

The cylinder block 11, the lower block 12, the crankcase 14 and the cylinder head 15 constitute an engine subassembly 50 of the present invention, and a space defined by the cylinder block 11, the lower block 12 and the crankcase 14 for accommodation of the crankshaft 13 constitutes a crank chamber 42 of the present invention.

Combustion chambers 20 formed in the cylinder head 15 so that they are opposed to top surfaces of the pistons 18, are connected to an intake manifold 22 through intake ports 21 opening into a left side of the cylinder head 15, i.e., toward a port in a travel direction of the boat, and also connected to an exhaust passage 24 in an engine room through exhaust ports 23 opening into a right side of the cylinder head 15. Intake valves 25 adapted to open and close downstream ends of the intake ports 21 and exhaust valves 26 adapted to open and close upstream ends of the exhaust ports 23 are driven to be opened and closed by a valve-operating mechanism 27 of a DOHC type accommodated within the head cover 16. An upstream portion of the intake manifold 22 is connected to a throttle valve 29 fixed to a front surface of the crankcase 14, so that intake air passed through a silencer 28 is supplied to the intake manifold 22. Injectors 58 for injecting a fuel into the intake ports 21 are mounted in an injector base 57 interposed between the cylinder head 15 and the intake manifold 22.

Figure 6:
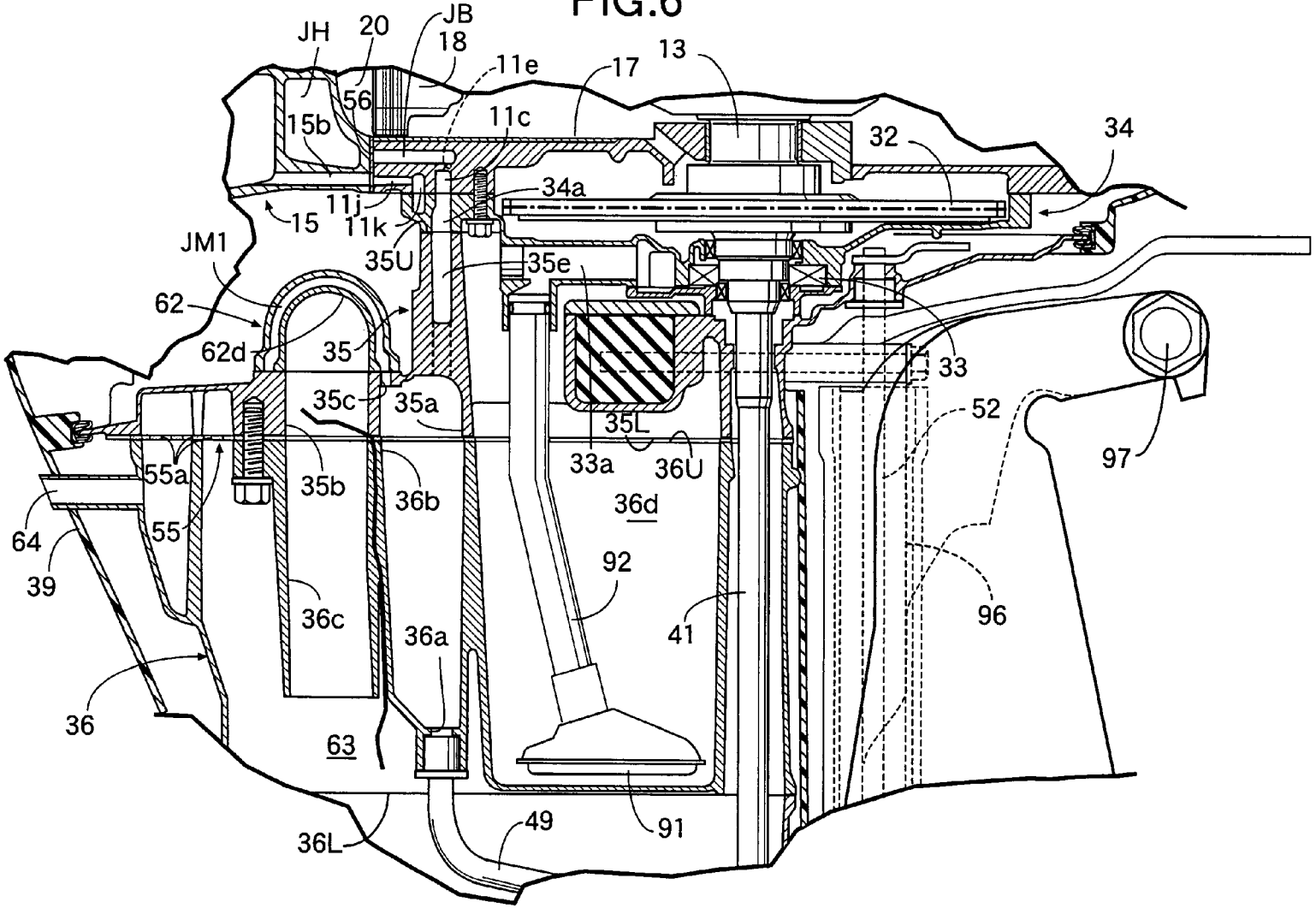
FIG. 6 is an enlarged sectional view of essential portions of FIG. 1.

An internal space in the head cover 16 accommodating the valve-operating mechanism 27 is connected to the silencer 28 through a coupling 94 and a breather pipe 95, and a blow-by gas leaked into the internal space in the head cover 16 is returned to an intake system. Reference numeral 67 in FIG. 6 is electric equipment box for accommodation of electric equipment; reference numeral 69 is an AC generator; reference numeral 70 is a starter motor; and reference numeral 99 is a pressure sensor for detecting a hydraulic pressure. The AC generator 69 is driven through a belt by a pulley 68 (see FIG. 13) mounted at an upper end of the crankshaft 13.

A chain cover 31 for accommodation of a timing chain 30 (see FIGS. 12, 13 and 21) for transmitting a driving force from the crankshaft 13 to the valve-operating mechanism 27 is coupled to upper surfaces of the cylinder block 11, the lower block 12, the crankcase 14 and the cylinder head 15 of the vertical engine E. An oil pump body 34 is coupled to lower surfaces of the cylinder block 11, the lower block 12 and the crankcase 14. Further, a mount case 35, an oil case 36, an extension case 37 and a gear case 38 are coupled sequentially to a lower surface of the oil pump body 34.

The oil pump body 34 is adapted to accommodate the oil pump 33 between its lower surface and an upper surface of the mount case 35. A flywheel 32 is disposed between the oil pump body 34 and lower surfaces of the cylinder block 11 and the like opposite from the oil pump body 34, and a flywheel chamber and an oil pump chamber are defined by the oil pump body 34. The oil case 36, the mount case 35 and a periphery of a lower portion of the vertical engine E are covered with an undercover 39 made of a synthetic resin, and an upper portion of the vertical engine E is covered with an engine cover 40 made of a synthetic resin and coupled to an upper surface of the undercover 39.

A drive shaft 41 connected to a lower end of the crankshaft 13 extends downwards into the extension case 37 through the pump body 34, the mount case 35 and the oil case 36, and is connected, through a forward/backward travel switchover mechanism 45 operated by a shifting rod 52, to a front end of a propeller shaft 44 which is provided at its rear end with a propeller 43 and supported longitudinally in the gear case 38. A lower water supply passage 48 extending upwards from a strainer 47 mounted on the gear case 38 is connected to a cooling-water pump 46 mounted on the drive shaft 41.

As shown in FIG. 6, a cooling-water supply bore 36*a* is formed in a lower surface 36L of the oil case 36, and an upper water supply pipe 49 is connected at its upper end to the cooling-water supply bore 36*a*. A cooling-water supply passage 36*b* leading to the cooling-water supply bore 36*a* is formed in an upper surface 36U of the oil case 36 to surround a portion of a periphery of an exhaust pipe portion 36*c* integrally formed on the oil case 36. A cooling-water supply passage 35*a* having the same shape as the cooling-water supply passage 36*b* and opening into the upper surface 36U of the oil case 36 is formed in a lower surface 35L of the mount case 35 to surround a portion of a periphery of an exhaust passage 35*b* extending through the mount case 35.

Figure 7:
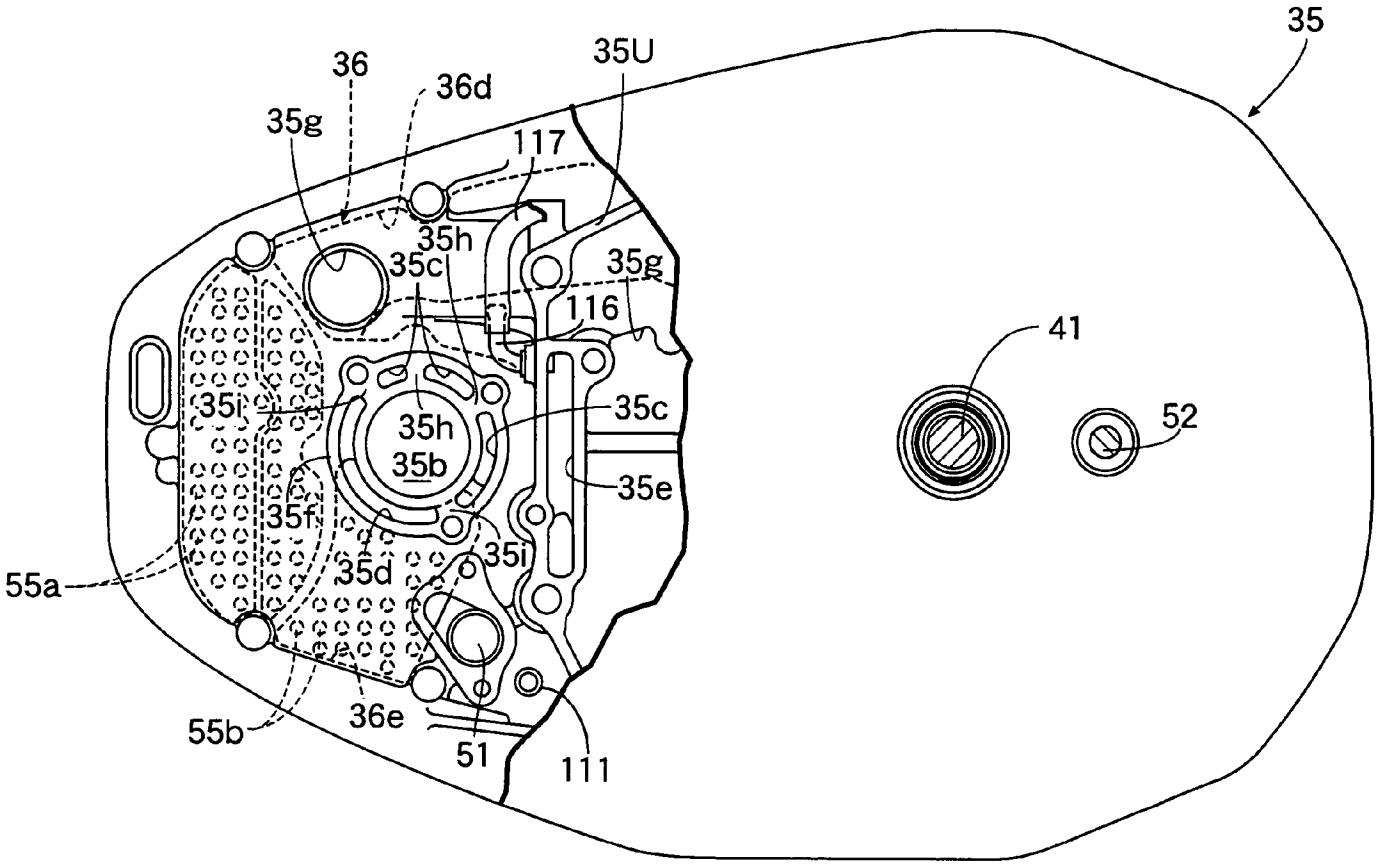
FIG. 7 is an enlarged view (a top view of a mount case) taken along a line 7—7 in FIG. 1.
Figure 8:
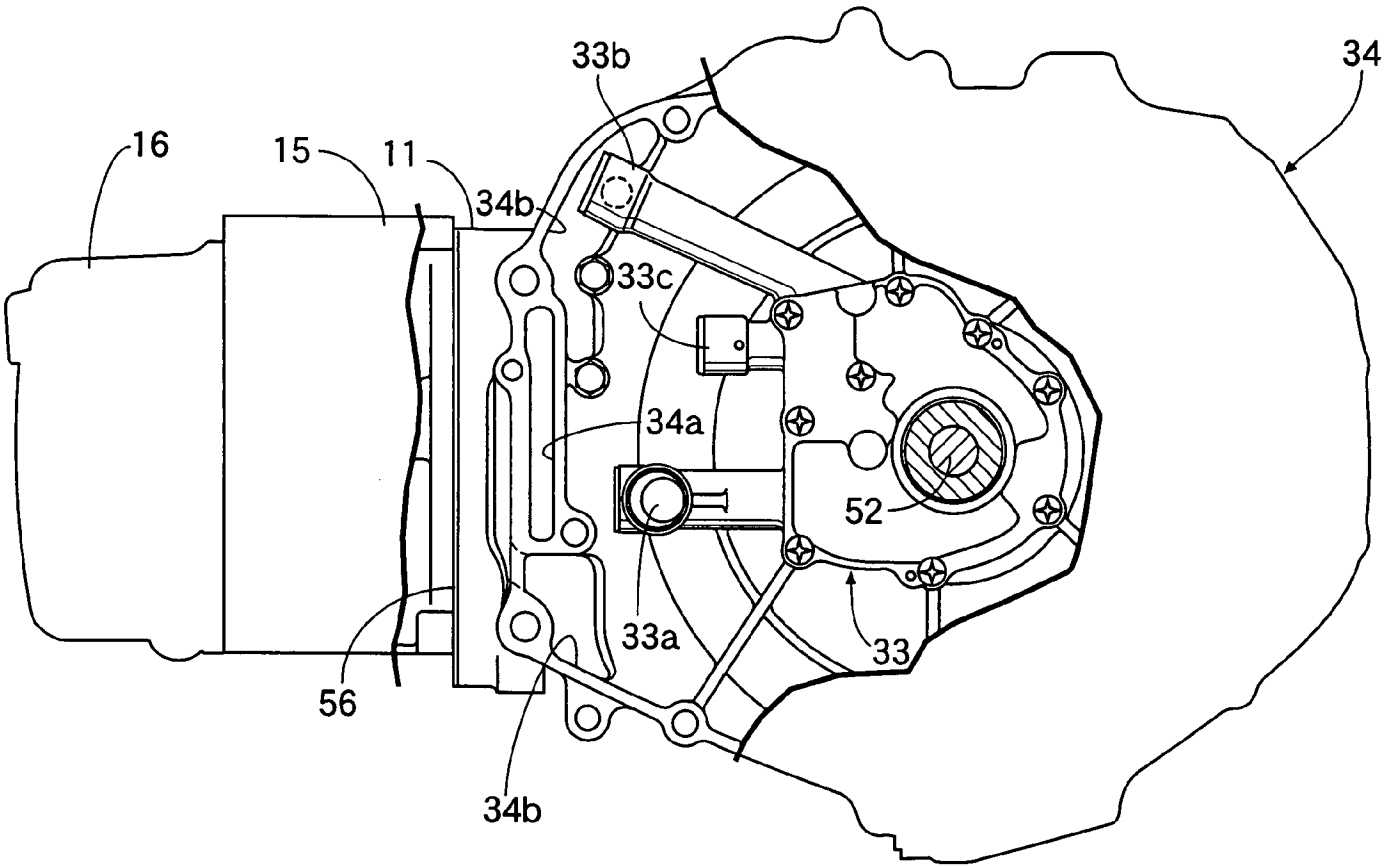
FIG. 8 is an enlarged view (a bottom view of a pump body) along a line 8—8 in FIG. 1.
Figure 9:
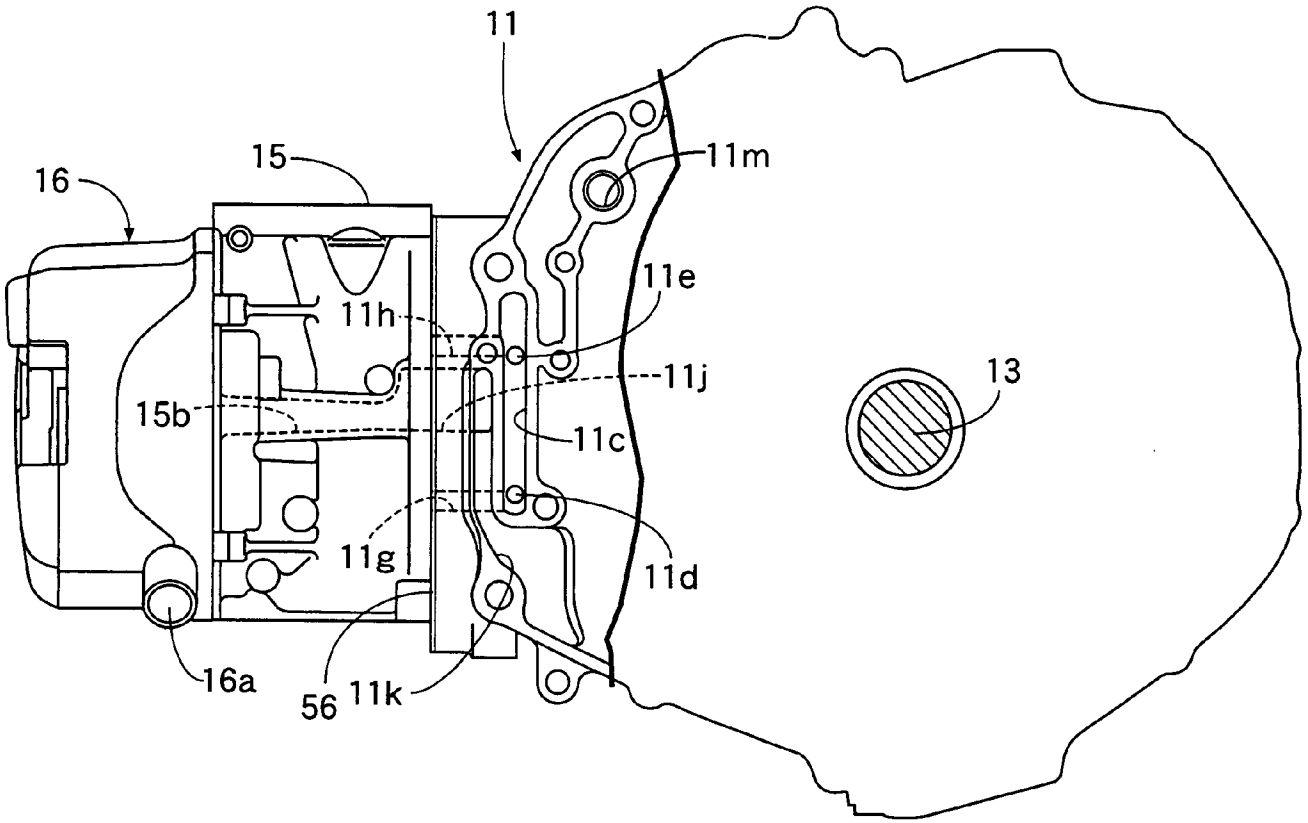
FIG. 9 is an enlarged view (a bottom view of an engine subassembly) along a line 9—9 in FIG. 1.
Figure 10:
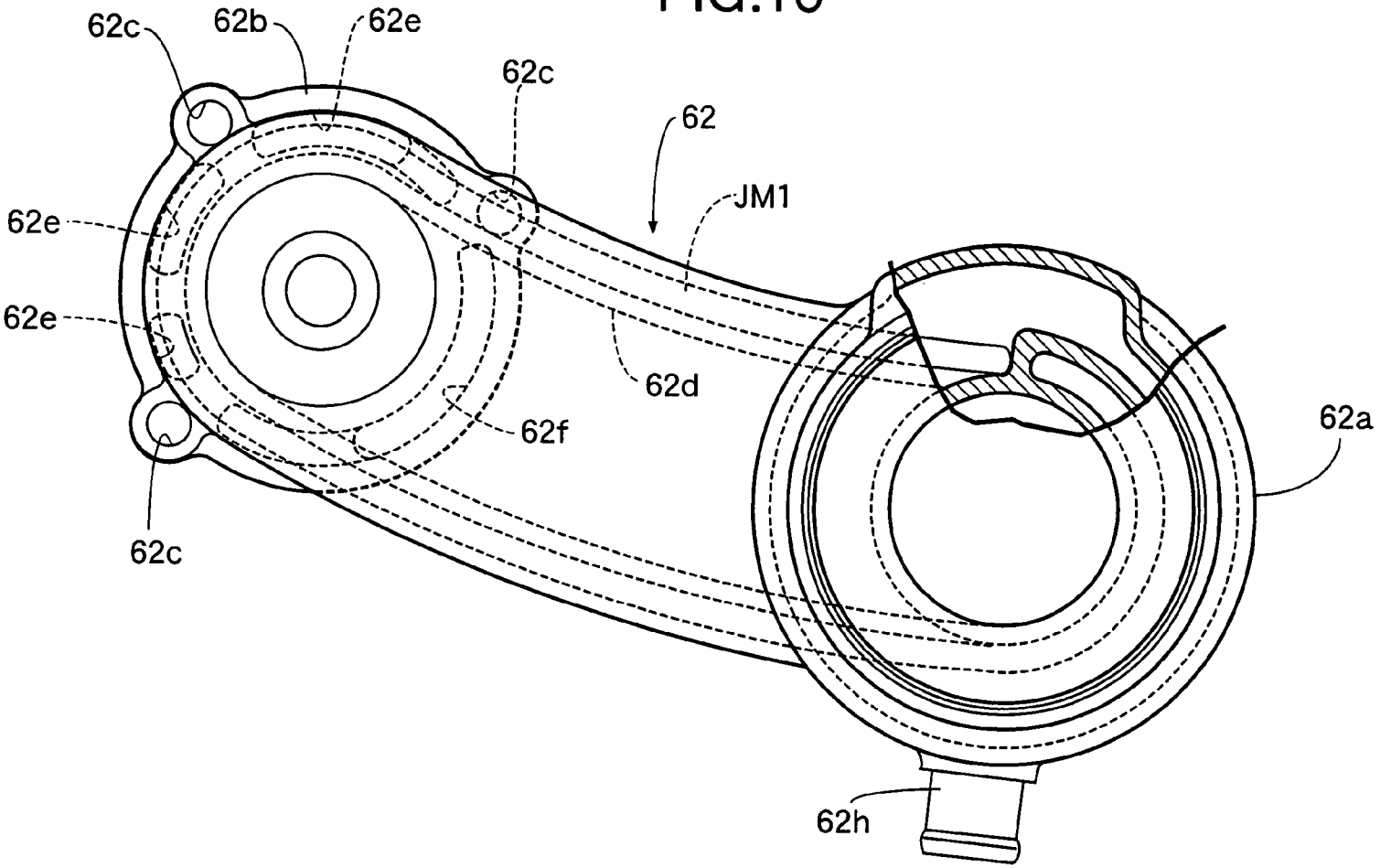
FIG. 10 is an enlarged view taken along a line 10—10 in FIG. 4.

FIG. 7 is a view of the mount case 35 as viewed from above, to a lower surface of which the oil case 36 is coupled. An outer periphery of the exhaust passage 35*b* is surrounded by cooling-water supply passages 35*c* and a cooling-water discharge passage 35*d*. More specifically, the cooling-water supply passages 35*c* (see FIG. 6) communicating with the cooling-water supply passage 35*a* formed to open downwards into the lower surface 35L of the mount case 35 are formed so that they open upwards into a portion of an upper surface 35U of the mount case 35 other than a portion where the cylinder block is mounted, and so that they extend along an outer periphery of the cylindrical discharge passage 35*b*. In the embodiment, the three arcuate cooling-water supply passages 35*c* are separated from one another by wall portions 35*h* continuous to an outer wall of the exhaust passage 35*b*. Further, the single arcuate cooling-water discharge passage 35*d* is formed outside an area in which the cooling-water supply passages 35*c* are provided and which is around an outer periphery of the cylindrical discharge passage 35*b*. The arcuate cooling-water discharge passage 35*d* is separated from the cooling-water supply passages 35*c* by wall portions 35*i* formed on the outer wall.

A cooling-water supply passage 35*e* is formed into a U-groove shape in the upper surface 35U of the mount case 35 to extend laterally of the outboard engine system O astride a central portion of the cylinder 17 as viewed in a plane and to open upwards into the upper surface 35U (see FIG. 6). The cooling-water supply passage 35*a* extends upwards to communicate with the cooling-water supply passage 35*e*. A relief valve 51 is mounted on the upper surface 35U of the mount case 35 and adapted to be opened to release cooling water when the pressure in the cooling-water supply passage 35*a* increases to a predetermined value or more (see FIGS. 4 and 7). A coupling 116 (see FIG. 7) leading to the cooling-water supply passage 35*e* is connected to a water-examining port 66 (see FIG. 22) through a hose 117.

The cooling-water discharge passage 35*d* communicates with an exhaust chamber 63 formed within the oil case 36, the extension case 37 and the gear case 38, through openings 36*e* (see FIG. 7) formed in the entire area of the lower surface 36L of the oil case 36. A gasket 55 interposed between the lower surface 35L of the mount case 35 and the upper surface 36U of the oil case 36 is provided with punched bores 55*a* through which the cooling water dropped from the cooling-water discharge passage 35*d* (see FIG. 7) of the mount case 35 is passed, and punched bores 55*b* defining a portion of the expansion chamber 63 to exhibit a silencing effect (see FIGS. 6 and 7).

The structure of the exhaust passage 24 within the engine room will be described below with reference to FIGS. 4 to 6 and 10.

An exhaust passage means for the vertical engine E is divided mainly into the exhaust passage 24 section within the engine room, and an exhaust chamber section separated from the engine room. The exhaust passage 24 within the engine room has an exhaust manifold 61 including: single pipe portions 61*a* which are coupled to a right side of the cylinder head 15, as described hereinafter, and into each of which an exhaust gas from each of the combustion chamber 20 is introduced, and a collection portion 61*b* in which the pipe portions 61*a* are collected at their downstream portions; and an exhaust gas guide 62 connected to the exhaust manifold 61 through a coupling portion 62*a* for guiding the exhaust gas to the outside of the engine room.

As can be seen from FIG. 6, the exhaust gas guide 62 is coupled to the upper surface 35U of the mount case 35 forming a partition wall of the engine room, to communicate with the exhaust passage 35*b* extending through the mount case 35. The exhaust passage 35*b* communicates with the exhaust pipe portion 36*c* integrally formed on the oil case 36 and also communicates with the exhaust chamber 63. In the embodiment, the oil case 36 forms an outer wall of the exhaust chamber 63 and also forms the exhaust pipe portion 36*c*, but in another construction, the exhaust pipe portion 36*c* may be a separate passage. The exhaust passage means may be of a construction in which a portion thereof is integrally continuous, but by forming the exhaust passage 24 within the engine room and the passages outside the engine room separately from each other, the assemblability of the various members and the sealability to the exhaust chamber 63 can be ensured.

An upper portion of the exhaust chamber 63 communicates with the outside of the undercover 39 through an exhaust gas discharge pipe 64 provided on the oil case 36, so that the exhaust gas is discharged into the atmosphere through the exhaust gas discharge pipe 64 without being discharged into water during the low-load operation of the vertical engine E.

A flange 62*b* formed at a lower end of the exhaust gas guide 62 is formed with three bolt bores 62*c*, three cooling-water inlet ports 62*e* defined into an arcuate shape to surround an exhaust passage 62*d*, and a single cooling-water outlet port 62*f*. When the flange 62*b* of the exhaust gas guide 62 is bolted to a mounting seat 35*f* (see FIG. 7) on the upper surface 35U of the mount case 35, the cooling-water inlet ports 62*e* in the exhaust gas guide 62 is brought into communication with the cooling-water supply passages 35*c* in the mount case 35, and the cooling-water outlet port 62*f* is brought into communication with the cooling-water discharge passage 35*d* in the mount case 35. On the side of the mounting seat 35*f* closer to the lower surface 35L of the mount case 35, aside of the outer wall forming the cooling-water discharge passage 35*d* opposite from the exhaust passage 35*b* lies at a location slightly higher in level than a gasket surface, and the cooling water is discharged from between a lower surface of the outer wall and the gasket surface onto a gasket 55.

The exhaust gas guide 62 is formed with a first exhaust gas guide-cooling water jacket JM1 covering a half of a periphery of an upper surface of the exhaust passage 62*d*, and a second exhaust gas guide-cooling water jacket JM3 covering a half of a periphery of a lower surface of the exhaust passage 62*d*. An exhaust manifold-cooling water jacket JM2 is formed to surround a periphery of the exhaust manifold 61, and when a lower end of the exhaust manifold 61 is fitted to an inner periphery of the coupling portion 62*a* of the exhaust gas guide 62, the exhaust manifold-cooling water jacket JM2 in the exhaust manifold 61 and the first exhaust gas guide-cooling water jacket JM1 in the exhaust gas guide 62 are brought into communication with each other.

Figure 4:
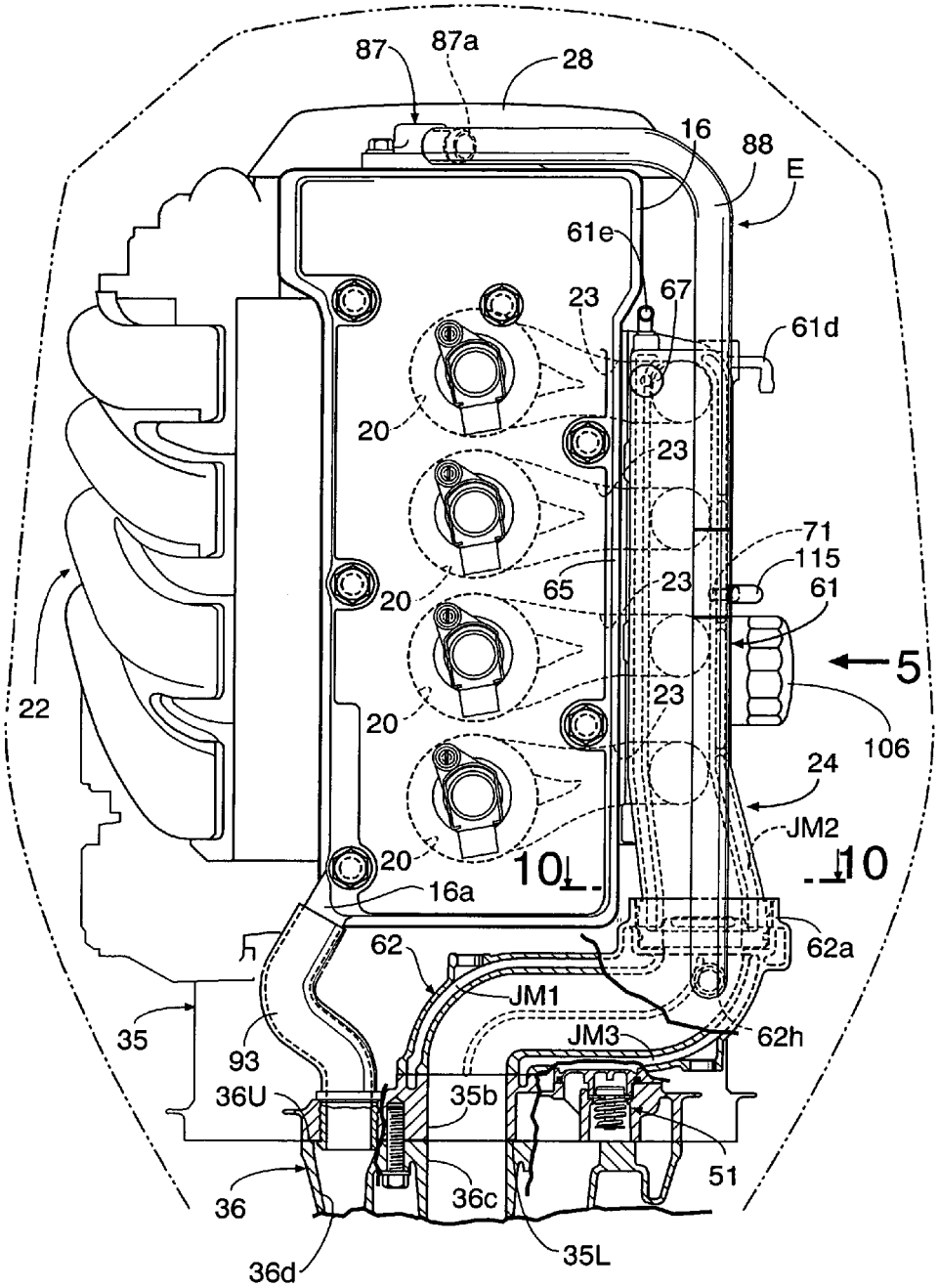
FIG. 4 is an enlarged view taken in a direction of an arrow 4 in FIG. 2.
Figure 5:
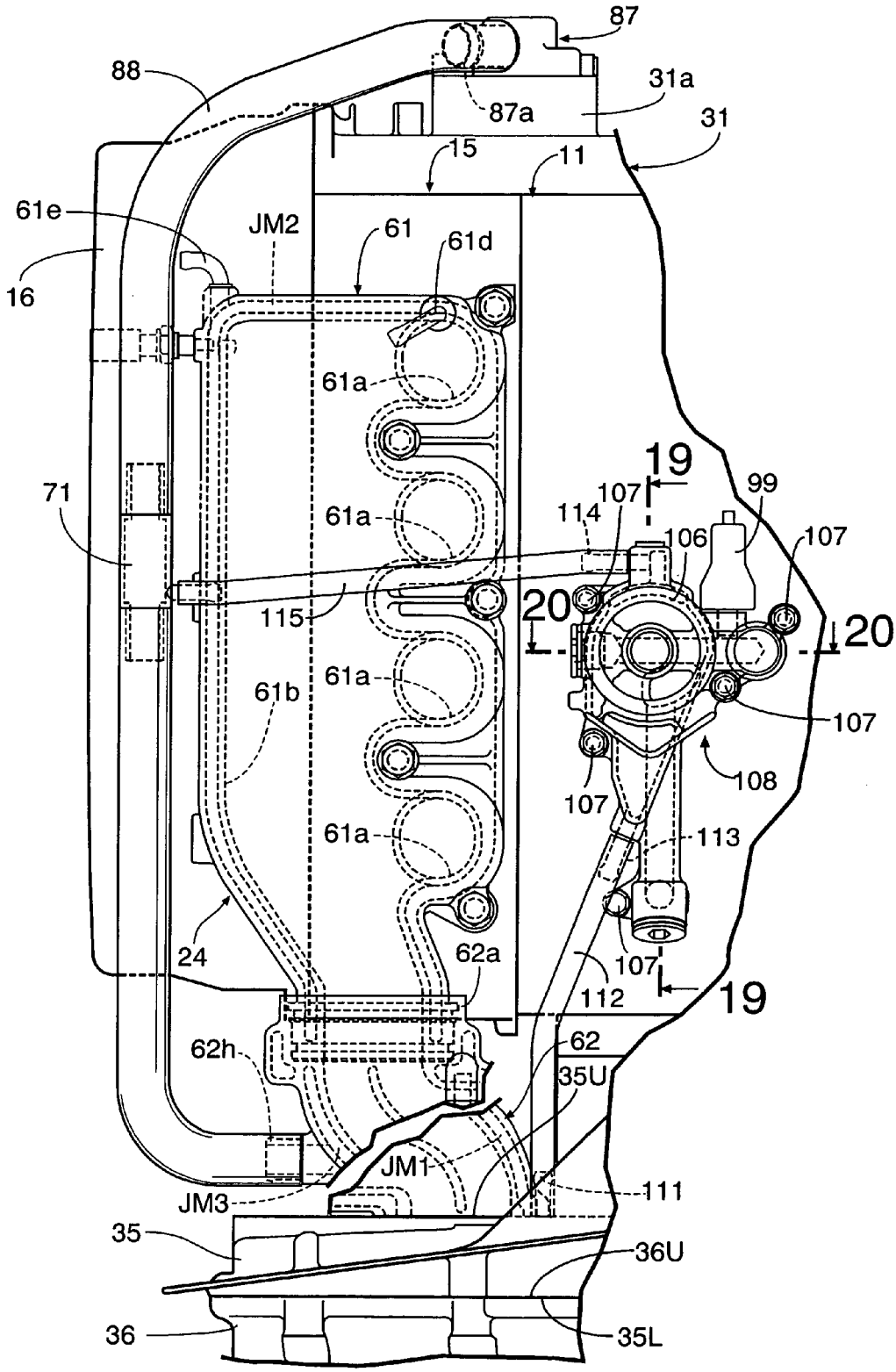
FIG. 5 is a view taken in a direction of an arrow 5 in FIG. 4.

As can be seen from FIGS. 4 and 5, two couplings 61*d* and 61*e* are provided at an upper portion of the exhaust manifold-cooling water jacket JM2, so that the cooling water in the exhaust manifold-cooling water jacket JM2 is discharged into the exhaust chamber 63 through the couplings 61*d* and 61*e* by a pipe line (not shown) or the like.

The structure of a cooling system in the cylinder block 11 will be described below with reference to FIGS. 3 and 7 to 9.

A slit-shaped cooling-water supply passage 34*a* formed to extend through the pump body 34 communicates with the slit-shaped cooling-water supply passage 35*e* (see FIG. 7) formed to extend through the mount case 35, and also communicates with a cooling-water supply passage 11*c* formed in the lower surface of the cylinder block 11 to extend laterally astride laterally widthwise central portions of the cylinders 17 and having the same mating-face shape as the cooling-water supply passage 35*e*. The cooling-water supply passage 11*c* in the cylinder block 11 is in the form of a groove with its lower surface opened, and communicates with a lower end of a cylinder block-cooling water jacket JB for the cylinder block 11 through two through-bores 11*d* and 11*e* extending through an upper wall of the groove.

The structure of a cooling system in the cylinder head 15 will be described below with reference to FIGS. 3, 6, 9 and 13.

Two short cooling-water supply passages 11*g* and 11*h* are branched toward the cylinder head 15 from a sidewall of the slit-shaped cooling-water supply passage 11*c* formed in the lower surface of the cylinder block 11, and communicate with a cylinder head-cooling water jacket JH for the cylinder head 15 through a gasket 56 between the cylinder block 11 and the cylinder head 15. The cylinder block-cooling water jacket JB surrounding the cylinders 17 in the cylinder block 11 is isolated from the cylinder head-cooling water jacket JH for the cylinder head 15 through the gasket 56 interposed between coupled surfaces of the cylinder block 11 and the cylinder head 15 (see FIGS. 2 and 6).

First and second thermostats 85 and 86 are accommodated within a thermostat-mounting seat 31*a* provided on the chain cover 31 covering the upper surfaces of the cylinder block 11 and the cylinder head 15, and upper ends JBe and JHe (see FIG. 12) of the cylinder block-cooling water jacket JB and the cylinder head-cooling water jacket JH are connected to the first and second thermostats 85 and 86, respectively. A draining pipe 88 extending from a coupling 87*a* of a thermostat cover 87 covering the thermostat-mounting seat 31*a* is connected to the second exhaust gas guide-cooling water jacket JM3 through a coupling 62*h* (see FIGS. 4 and 5) provided on the exhaust gas guide 62.

Figure 11:
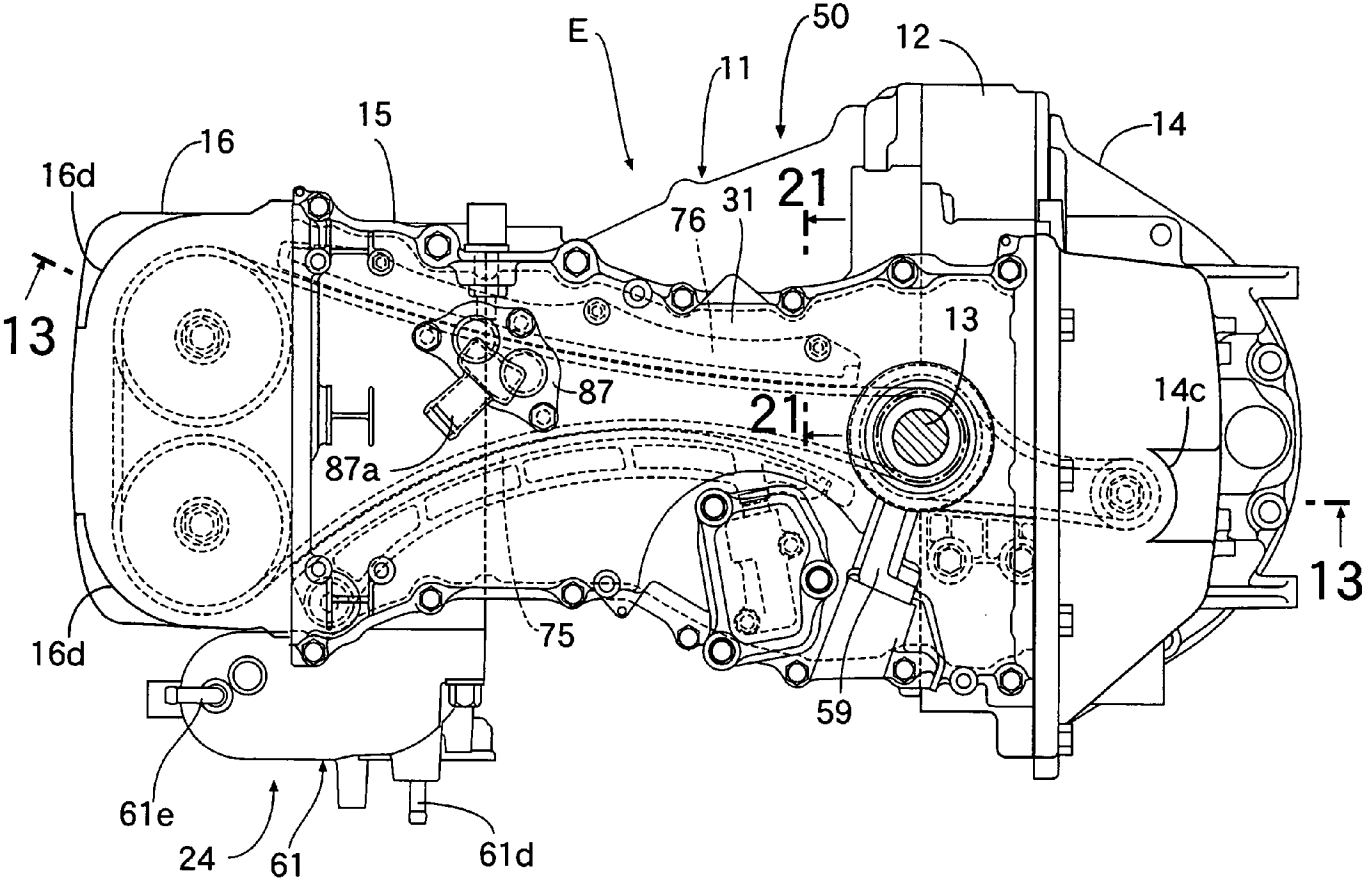
FIG. 11 is an enlarged view taken along a line 11—11 in FIG. 1.

The structure of a system for driving camshafts 73, 73 and balancer shafts 78 and 79 by the crankshaft 13 will be described below with reference to FIGS. 11 to 13.

The timing chain 30 comprising a silent chain generating less noise is reeved around a cam-driving sprocket 72 mounted at the upper end of the crankshaft 13 and cam follower sprockets 74, 74 mounted on a pair of camshafts 73, 73 located at a rear portion of the cylinder head 15. A hydraulic chain tensioner 75 is mounted in abutment against a loosened side of the timing chain 30, and a chain guide 76 is mounted in abutment against an opposite side of the timing chain 30. The number of teeth of the cam-driving sprocket 72 is half of the number of teeth of each of the cam follower sprockets 74, 74 and hence, the camshafts 73, 73 are rotated at a number of rotations half of that of the crankshaft.

Figure 21:
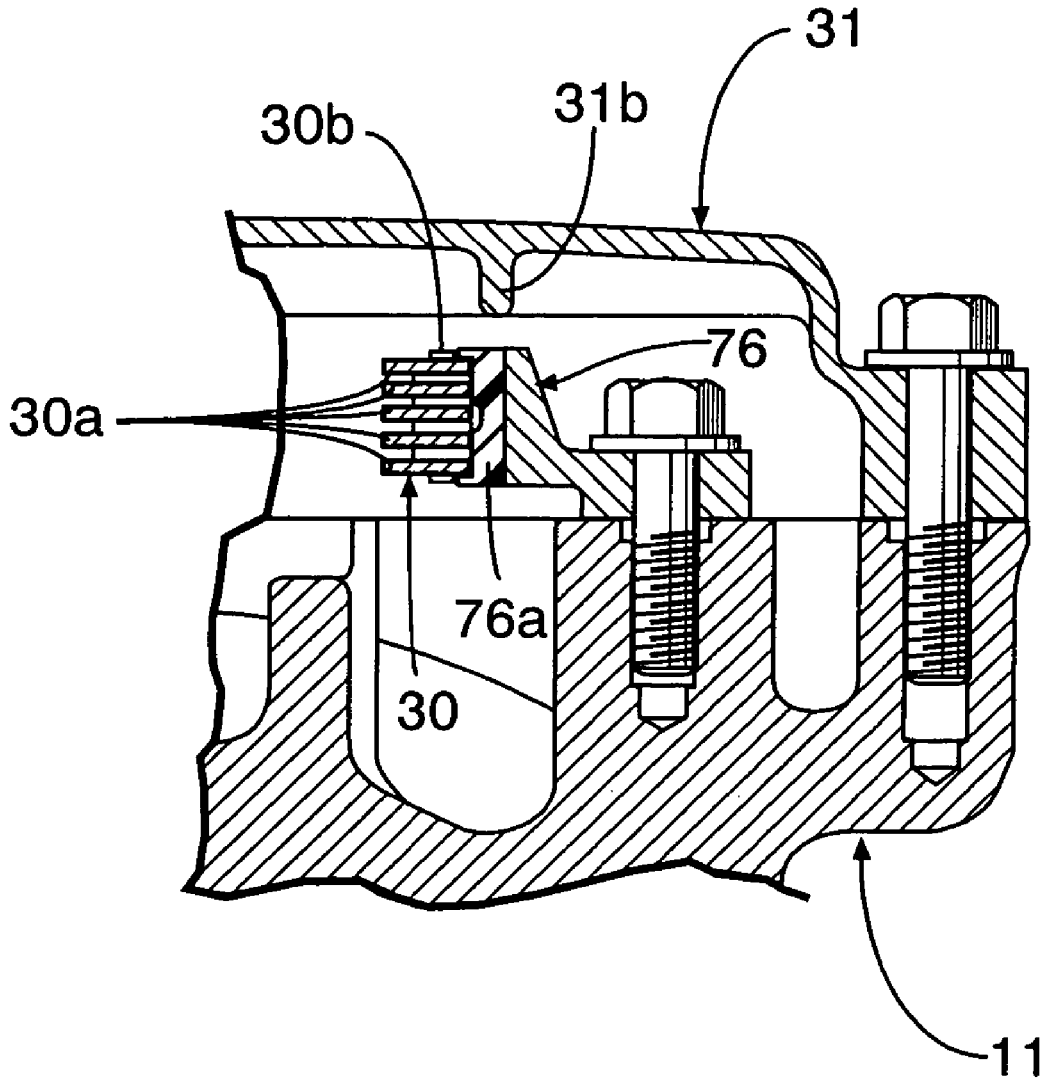
FIG. 21 is an enlarged sectional view taken along a line 21—21 in FIG. 11.

As shown in detail in FIG. 21, the timing chain 30 comprising the silent chain includes a plurality of plates 30*a* connected together in an endless fashion by pins 30*b*, so that teeth formed on the plates 30*a* are meshed with the cam-driving sprocket 72 and the cam follower sprockets 74, 74. The timing chain 30 is guided along a synthetic resin guide portion 76*a* made provided on the chain guide 76.

A balancer device 77 is accommodated within the crankcase 14, and a balancer-driving chain 82 comprising a silent chain is reeved around a balancer follower sprocket 80 mounted on one of two balancer shafts 78 and 79 and around a balancer-driving sprocket 81 mounted on the crankshaft 13. A chain tensioner 83 is mounted in abutment against a loosened side of the balancer-driving chain 82, and a chain guide 84 is mounted in abutment against an opposite side of the balancer-driving chain 82. The number of teeth of the balancer-driving sprocket 81 is twice as large as that of balancer follower sprocket 80 and hence, the balancer shafts 78 and 79 are rotated at a number of rotations twice as large as that of the crankshaft 13.

The cam-driving sprocket 72, the cam follower sprockets 74 and the timing chain 30 constitute a first chain mechanism 89, and the balancer-driving sprocket 81, the balancer follower sprocket 80 and the balancer-driving chain 82 constitute a second chain mechanism 90.

The chain cover 31, an upper portion of the crankcase 14 and an upper portion of the head cover 16 define a chain chamber 54 in which the first and second chain mechanisms 89 and 90 are accommodated.

Figure 12:
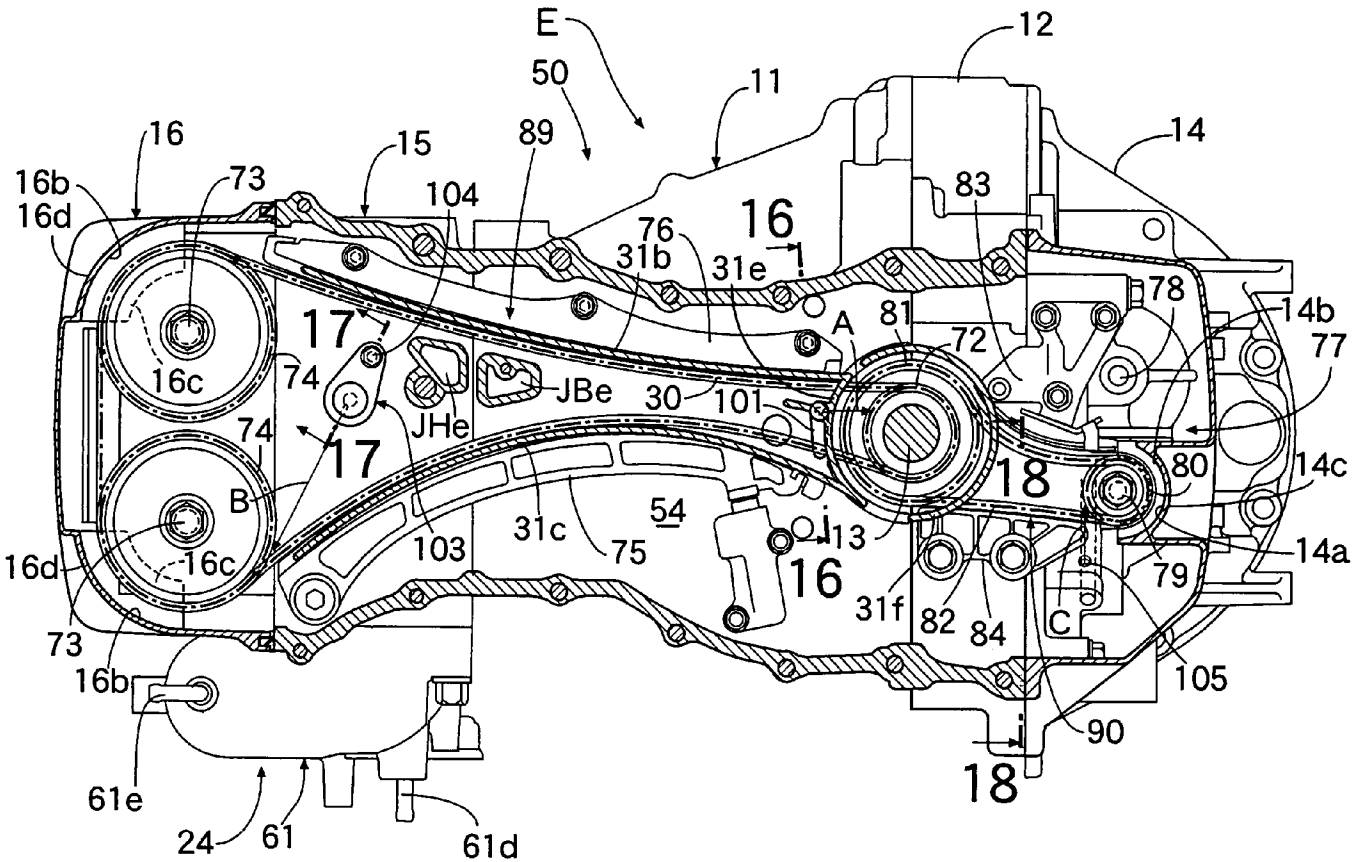
FIG. 12 is an enlarged sectional view taken along a line 12—12 in FIG. 1.
Figure 14:
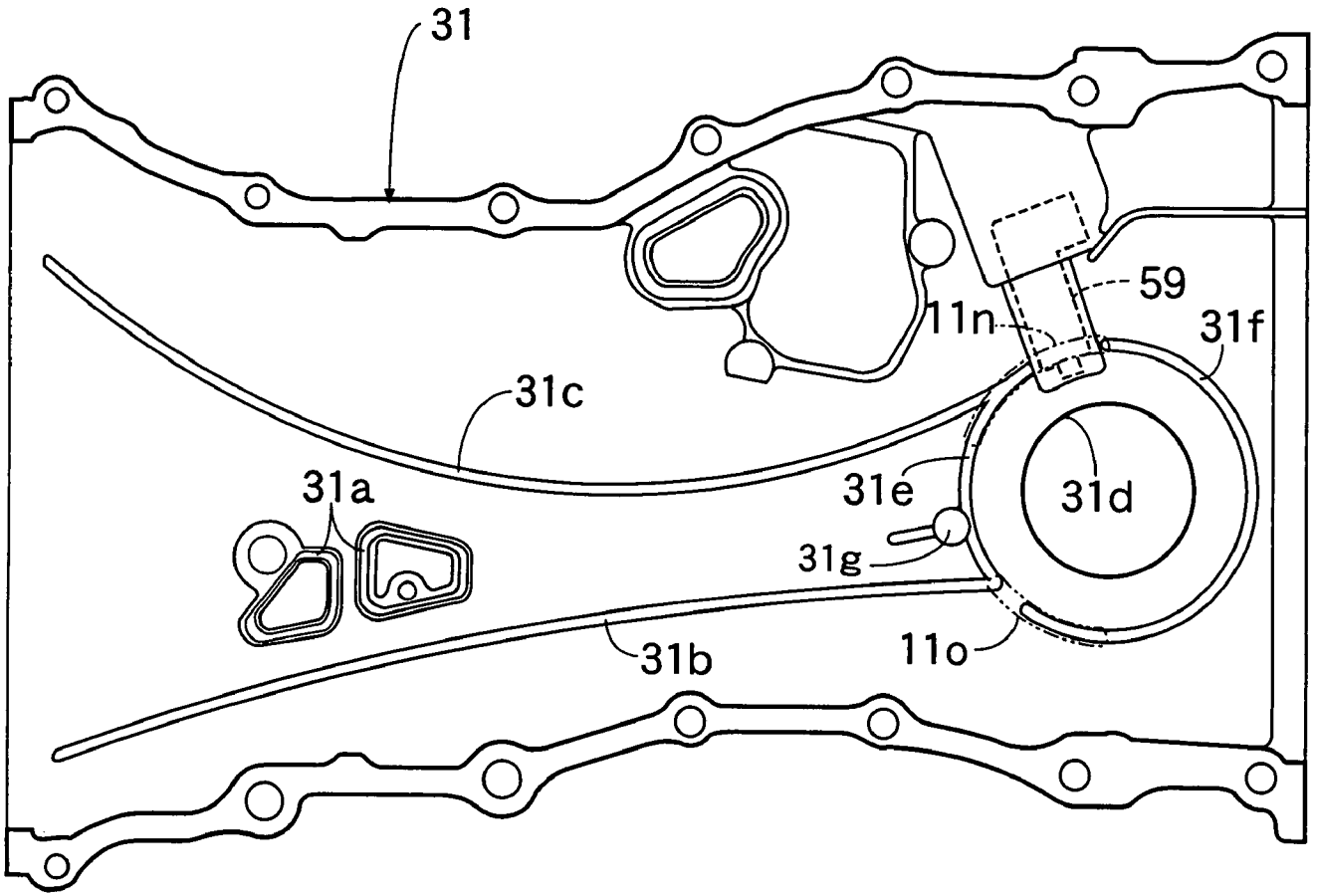
FIG. 14 is an enlarged view taken along a line 14—14 in FIG. 1.

As can be seen from FIGS. 12, 14 and 21, first and second curved ribs 31*b* and 31*c* hang from a lower surface of the chain cover 31. A lower surface of the first rib 31*b* is disposed in proximity to an upper surface of the chain 30 which is moved along the chain guide 76 fixed to the upper surfaces of the cylinder block 11 and the cylinder head 15, and a lower surface of the second rib 31*c* is disposed in proximity to the upper surface of the chain 30 which is moved along the chain tensioner 75 mounted on the upper surfaces of the cylinder block 11 and the cylinder head 15.

A third circular rib 31*e* also hangs from the lower surface of the chain cover 31 to surround a portion of a periphery of an opening 31*d* through which the crankshaft 13 extends, and the first and second ribs 31*b* and 31*c* are connected at their ends to opposite ends of the third rib 31*e*, respectively. Further, a fourth arcuate rib 31*f* hangs from the lower surface of the chain cover 31 to surround a portion of the periphery of the opening 31*d*. That is, the substantially entire region of the outer periphery of the opening 31*d* is surrounded by the third and fourth ribs 31*e* and 31*f*. Lower ends of the first, second and third ribs 31*b*, 31*c* and 31*e* terminate in locations higher in level than the upper end of the timing chain 30, but a lower end of the fourth rib 31*f* extends at substantially the same level as the lower end of the timing chain 30 and to a location higher in level than the lowermost packing face of the chain cover 31.

A detecting portion of an engine rotational speed sensor 59 for detecting a rotational speed of the crankshaft 13 is inserted into a clearance formed between opposed ends of the third and fourth ribs 31*e* and 31*f*, and is opposed an outer peripheral surface of a rotational speed-detecting rotor 60 fixed to the crankshaft 13.

Figure 15:
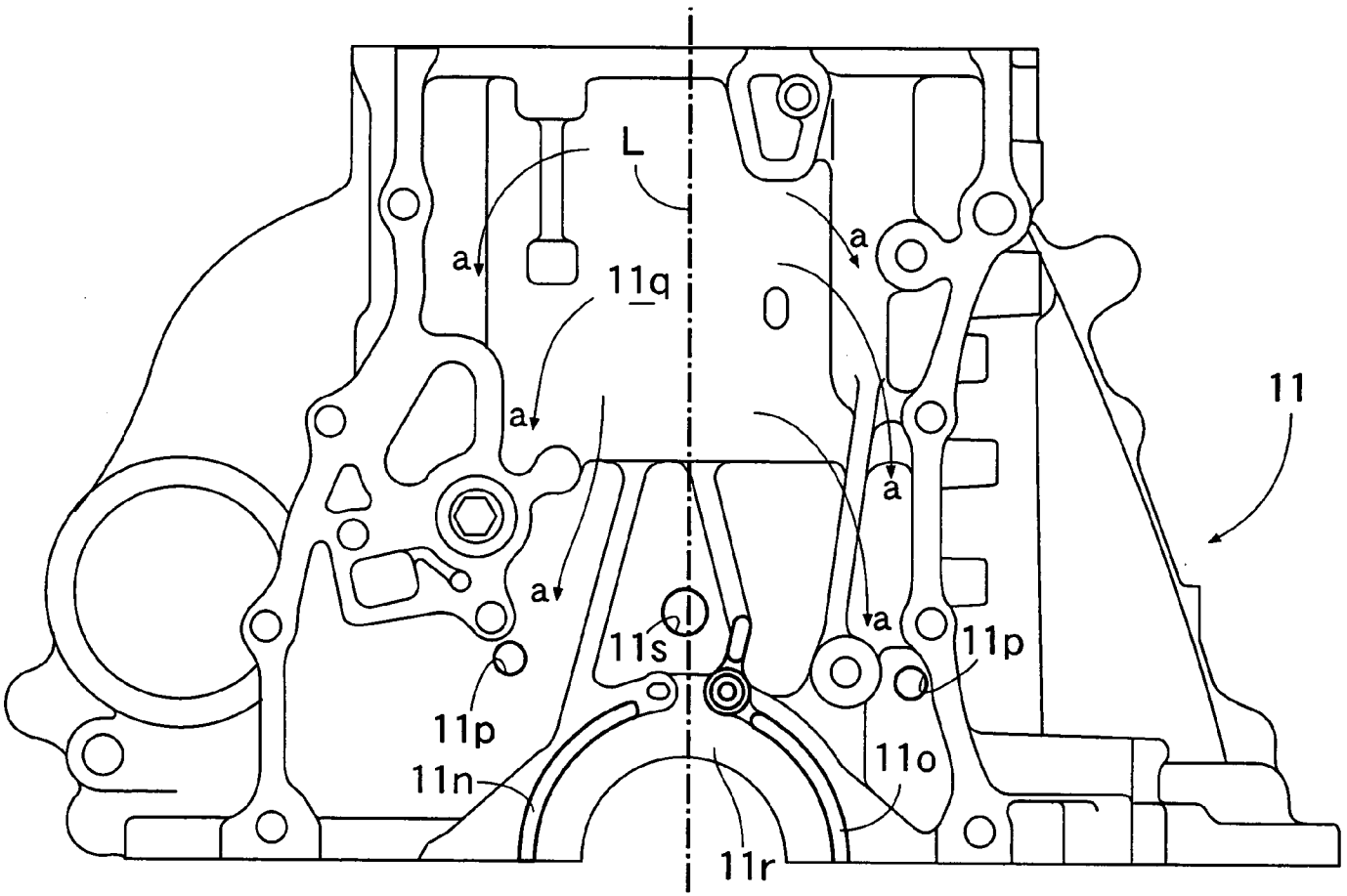
FIG. 15 is an enlarged view taken along a line 15—15 in FIG. 1.

As can be seen from FIGS. 14 and 15, first and second arcuate ribs 11*n* and 11*o* protrude upwards from the upper surface of the cylinder block 11, and upper ends of the first and second ribs 11*n* and 11*o* are opposed to the lower ends of the third and fourth ribs 31*e* and 31*f* of the chain cover 31.

As can be seen from FIGS. 11 to 14 and 18, the crankcase 14 covering the balancer device 77 includes a vertical wall 14*a* disposed to surround substantially a half of the balancer-driving sprocket 81 farther from the crankshaft 13, and an arcuate horizontal wall 14*b* extending in a horizontal direction from a lower end of the vertical wall 14*a* so that it is opposed to a lower surface of the balancer-driving sprocket 81. The vertical wall 14*a* and the horizontal wall 14*b* are formed integrally with the crankcase 14 by providing a recess 14*c* (see FIG. 11) protruding inwards at a portion of the crankcase 14.

The head cover 16 covering the valve-operating mechanism 27 includes: vertical walls 16*b*, 16*b* each disposed to surround approximately one fourth of an outer periphery of a travel locus of the timing chain 30 on a side of each of the pair of cam follower sprockets 74, 74 farther from the crankshaft 13; and arcuate horizontal walls 16*c*, 16*c* extending in a horizontal direction from lower ends of the vertical walls 16*b*, 16*b*, so that they are opposed to the lower surfaces of the cam follower sprockets 74, 74. The vertical walls 16*b*, 16*b* and the horizontal walls 16*c*, 16*c* are formed integrally with the head cover 16 by providing recesses 16*d*, 16*d* (see FIG. 11) protruding inwards at a portion of the head cover 16.

The structure of a lubricating system for the vertical engine E will be described below.

As shown in FIGS. 3, 4 and 6 to 9, the oil case 36 is integrally provided with an oil pan 36*d*, and accommodates a suction pipe 92 including an oil strainer 91. An oil suction passage 33*a*, an oil discharge passage 33*b* and an oil relief passage 33*c* are provided in the oil pump 33. The oil suction passage 33*a* is connected to a suction pipe 92; the oil discharge passage 33*b* extends from an outlet which extends to a back of a sheet surface of FIG. 8 and is connected to various portions to be lubricated of the vertical engine E via an oil passage (not shown) in the mount case 35 and an oil supply bore 11*m* (see FIG. 9) formed in the lower surface of the cylinder block 11; and the oil relief passage 33*c* is adapted to discharge the oil returned from the oil pump 33 into the oil pan 36*d*.

A portion of the oil returned from the valve-operating mechanism 27 provided in the cylinder head 15 and the head cover 16 is returned to the oil pan 36*d* through a coupling 16*a* mounted in the head cover 16, an oil hose 93 and an oil return passage 35*g* (see FIG. 7) extending through the mount case 35, and another portion of the oil returned from the valve-operating mechanism 27 is returned to the oil pan 36*d* via an oil return passage 15*b* (see FIGS. 6 and 9) formed in the cylinder head 15, an oil return passage 11*j* (see FIG. 9) opening into the packing surfaces of the cylinder block 11 and the cylinder head 15, an oil return passage 11*k* (see FIG. 9) extending through the cylinder block 11, an oil return passage 34*b* (see FIG. 8) extending through the pump body 34 and the oil return passage 35*g* (see FIG. 7) extending through the mount case 35. The oil return passage 11*j* opening into the gasket 56 between the cylinder block 11 and the cylinder head 15 is disposed so that it is interposed between two cooling-water passages 11*g* and 11*h* opening into the oil return passage 11*j* (see FIG. 3).

The oil returned from the crankcase 14 is returned to the oil pan 36*d* through an oil return passage (not shown) extending through the pump body 34 and the oil return passage 35*g* (see FIG. 7) extending through the mount case 35.

As can be seen from FIGS. 3 and 15, two oil return bores 11*p*, 11*p* are formed in an upper wall of the cylinder block 11 covered with the chain cover 31, so that they are disposed on the left and right sides of a cylinder axis L. A bulged portion 11*q* of a partially cylindrical shape corresponding to the uppermost cylinder 17 protrudes upwards on the cylinder axis L; other portions of the cylinder block 11 are at locations lower in level than the bulged portion 11*q*, and the oil return bores 11*p*, 11*p* open at such lower locations.

Five oil return bores 11*s* are formed on the cylinder axes L intermediate between the two oil return bores 11*p*, 11*p* to extend axially of the crankshaft 13 through five journal-supporting walls 11*r* for supporting journals 13*a* of the crankshaft 13. The uppermost oil return bore 11*s* communicates with the chain chamber 54, the lowermost oil return bore 11*s* communicates with the oil pan 36*d* via the inside of the mount case 35.

Figure 13:
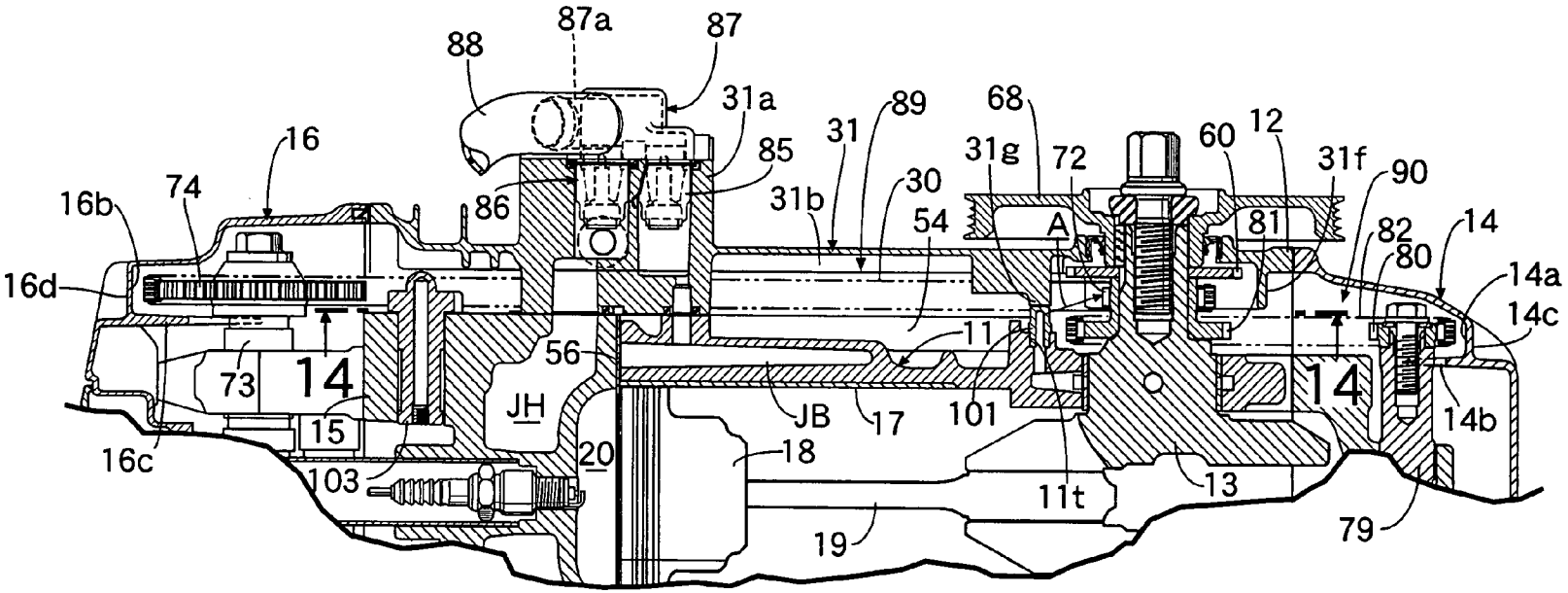
FIG. 13 is an enlarged sectional view taken along a line 13—13 in FIG. 11.
Figure 16:
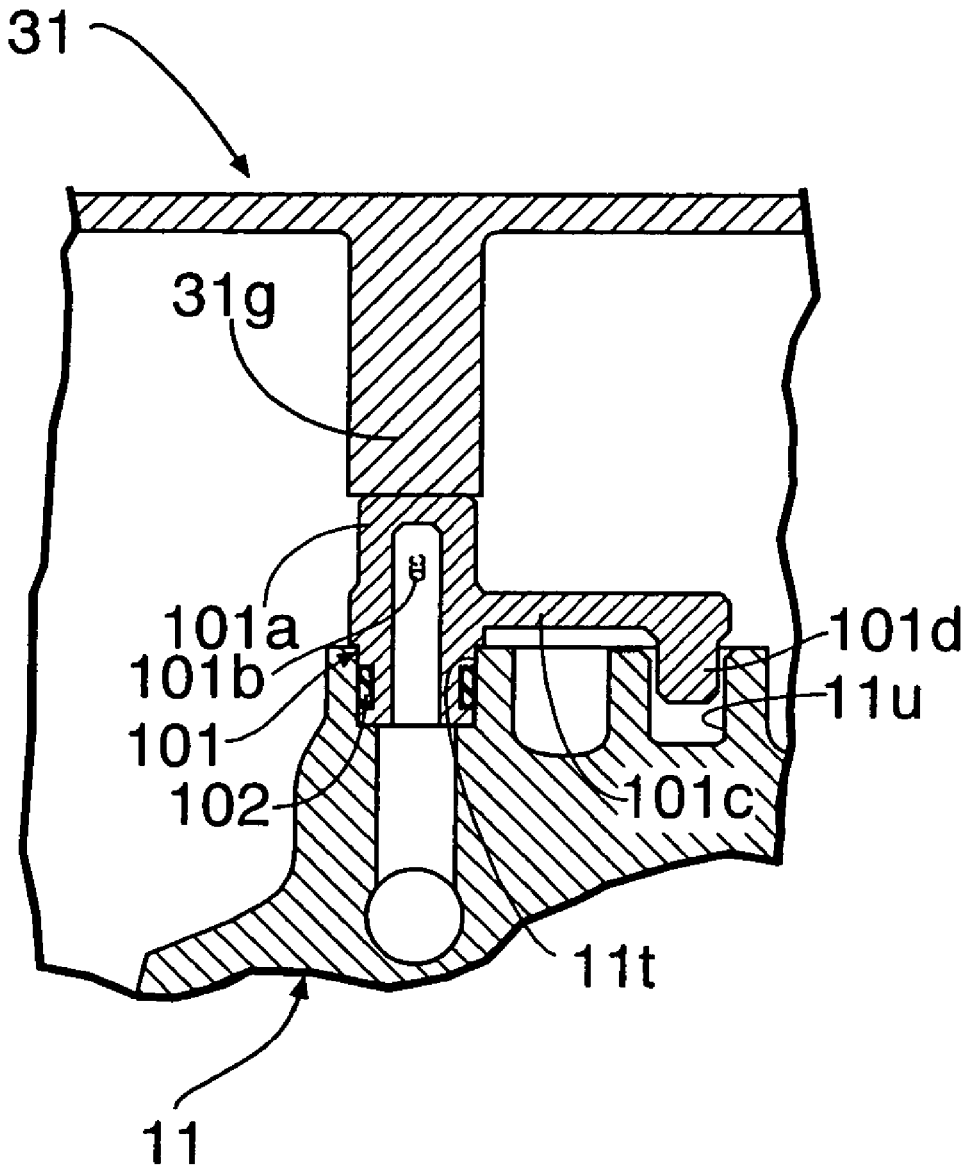
FIG. 16 is an enlarged sectional view taken along a line 16—16 in FIG. 12.

As can be seen from FIGS. 12, 13 and 16, a first oil jet 101 is mounted on the upper surface of the cylinder block 11 at a location closer to the crankshaft 13 to lubricate the timing chain 30 meshed with the cam-driving sprocket 72 mounted on the crankshaft 13 and the balancer-driving chain 82 meshed with the balancer-driving sprocket 81 mounted on the crankshaft 13.

The first oil jet 101 includes a jet body 101*a* fitted in an oil jet support bore 11*t* formed in the cylinder block 11, a nozzle 101*b* opening into an upper portion of the jet body 101*a*, an arm portion 101*c* extending sideways from the jet body 101*a*, and a positioning projection 101*d* formed at a tip end of the arm portion 101*c* and fitted in a positioning bore 11*u* in the cylinder block 11. A seal member 102 is mounted around an outer periphery of the jet body 101*a* fitted in the oil jet support bore 11*t*. In order to fix the first oil jet 101 to the cylinder block 11, a retaining projection 31*g* hanging from a ceiling surface of the chain cover 31 is provided to abut against an upper surface of the jet body 101*a*.

In this way, the first oil jet 101 is fitted in the oil jet support bore 11*t* in the cylinder block 11, and the retaining projection 31*g* of the chain cover 31 is provided to abut against the upper end of the jet body 101*a*. Therefore, it is possible to fix the first oil jet 101 without need for a special fixing member such as a bolt; a thick boss having a bolt bore is not required to be mounted in a narrow space in the vicinity of the crankshaft 13; and the first oil jet 101 can be disposed easily.

The nozzle 101*b* of the first oil jet 101 points diagonally upwards through a space below the third rib 31*e* hanging from the ceiling surface of the chain cover 31, and injects the oil supplied from the oil jet support bore 11*t* toward the cam-driving sprocket 72 mounted on the crankshaft 13, as shown by an arrow A in FIGS. 12 and 13.

Figure 17:
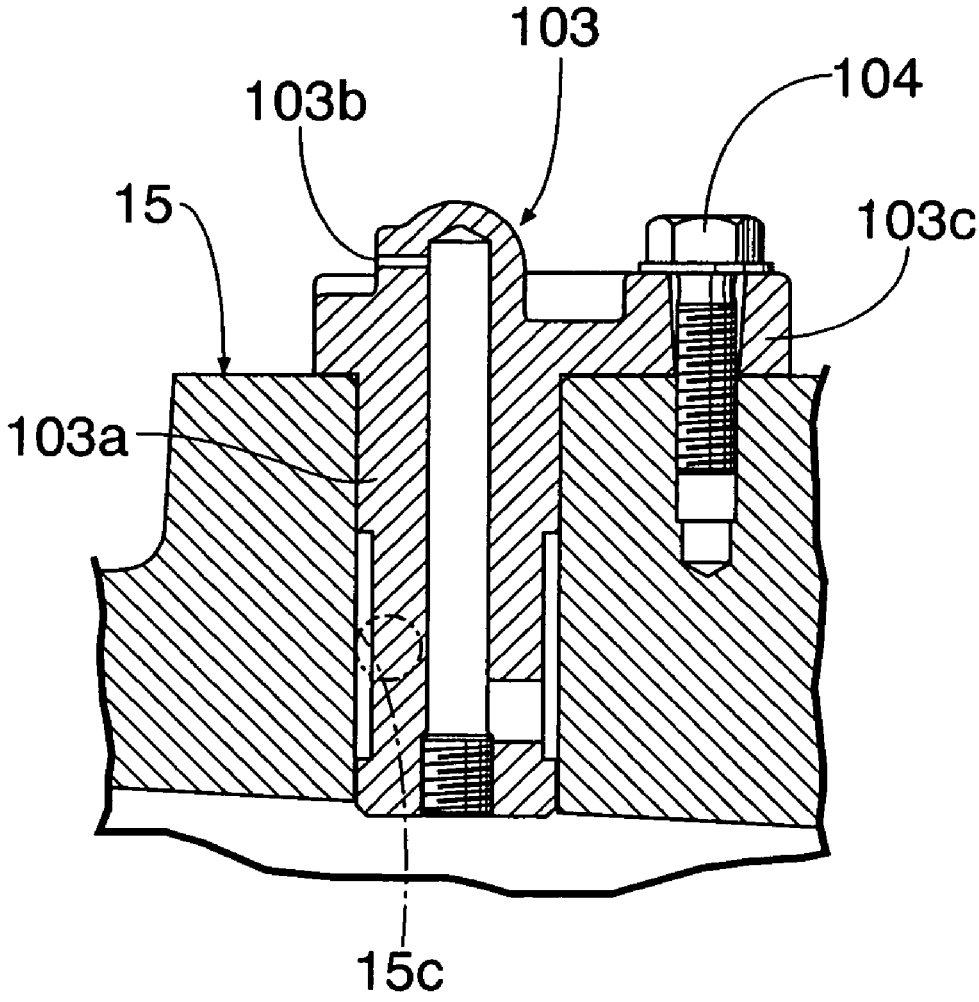
FIG. 17 is an enlarged sectional view taken along a line 17—17 in FIG. 12.

As can be seen from FIGS. 12, 13 and 17, a second oil jet 103 for lubricating the timing chain 30 meshed with the cam follower sprocket 74 mounted on one of the camshafts 73 is mounted on the upper surface of the cylinder head 15. The second oil jet 103 includes a jet body 103*a* fitted in an oil supply passage 15*c* formed in the cylinder head 15, a nozzle 103*b* opening substantially horizontally into an upper portion of the jet body 103*a*, and an arm portion 103*c* extending sideways from the jet body 103*a*. The second oil jet 103 is fixed to the cylinder head 15 by a bolt 104 passed through the arm portion 103*c*.

The oil injected substantially horizontally by the second oil jet 103 points to a position in which the timing chain 30 is meshed with the one cam follower sprocket 74 in the vicinity of an upstream end of the chain tension 75, as shown by an arrow B in FIG. 12.

Figure 18:
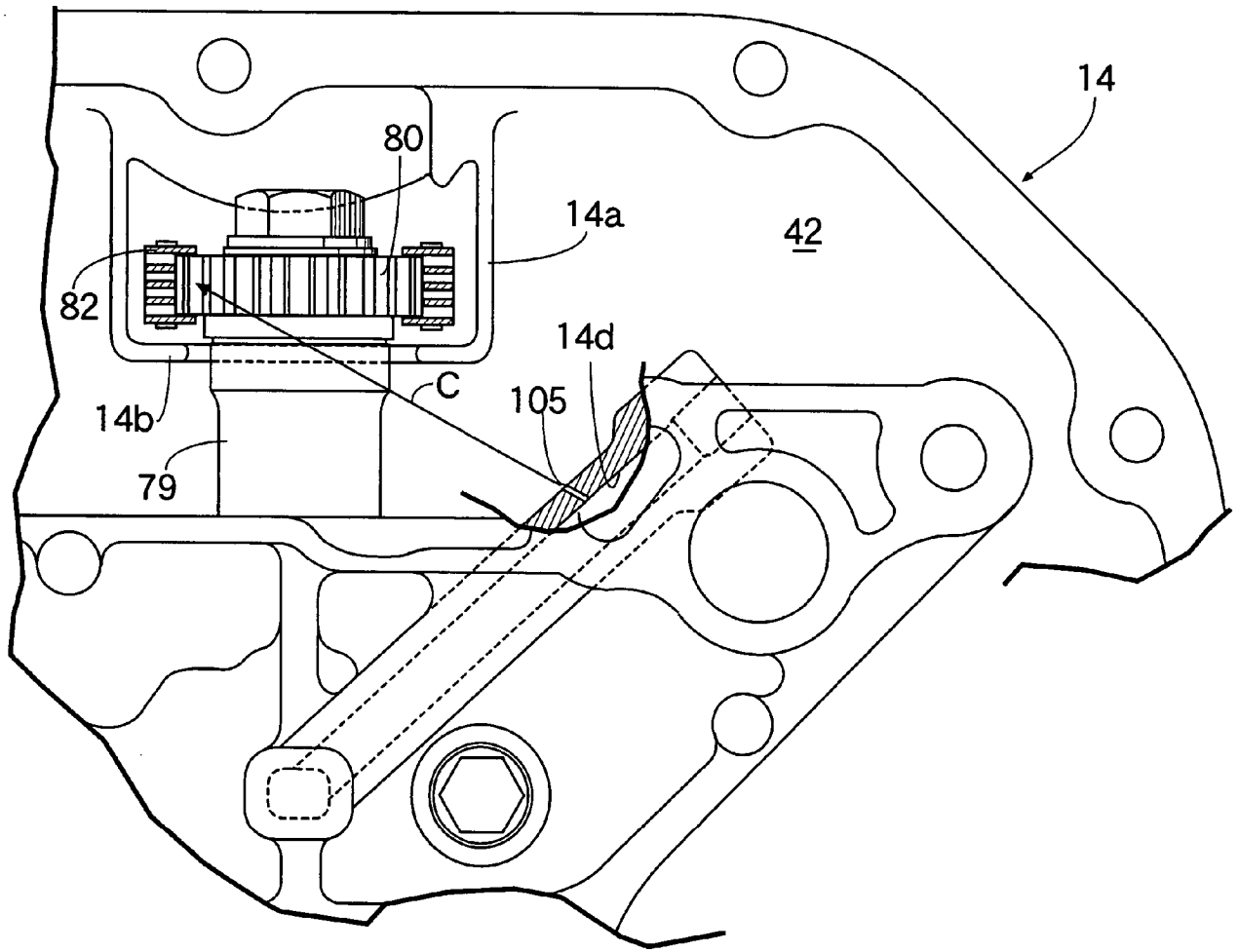
FIG. 18 is an enlarged sectional view taken along a line 18—18 in FIG. 12.
Figure 19:
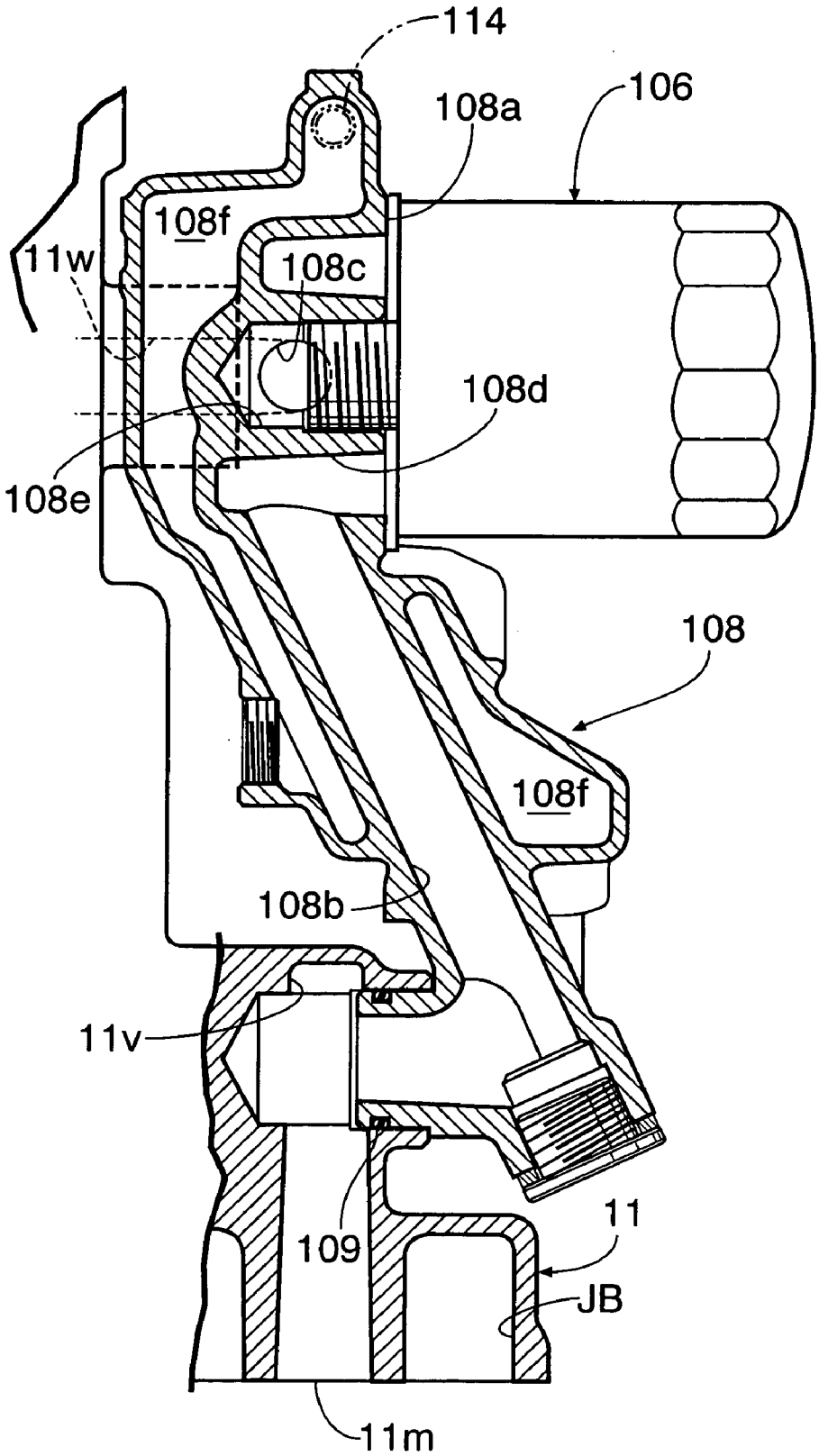
FIG. 19 is an enlarged sectional view taken along a line 19—19 in FIG. 5.

As can be seen from FIGS. 12 and 18, a third oil jet 105 for lubricating the balancer-driving chain 82 meshed with the balancer follower sprocket 80 mounted on the one balancer shaft 79 is mounted within the crankcase 14. The third oil jet 105 opens diagonally upwards into an oil supply passage 14*d* formed in the crankcase 14, and the oil injected diagonally upwards by the third oil jet 105 points to the balancer-driving chain 82 immediately before being meshed into the balancer follower sprocket 80, as shown by an arrow C in FIG. 12.

Figure 20:
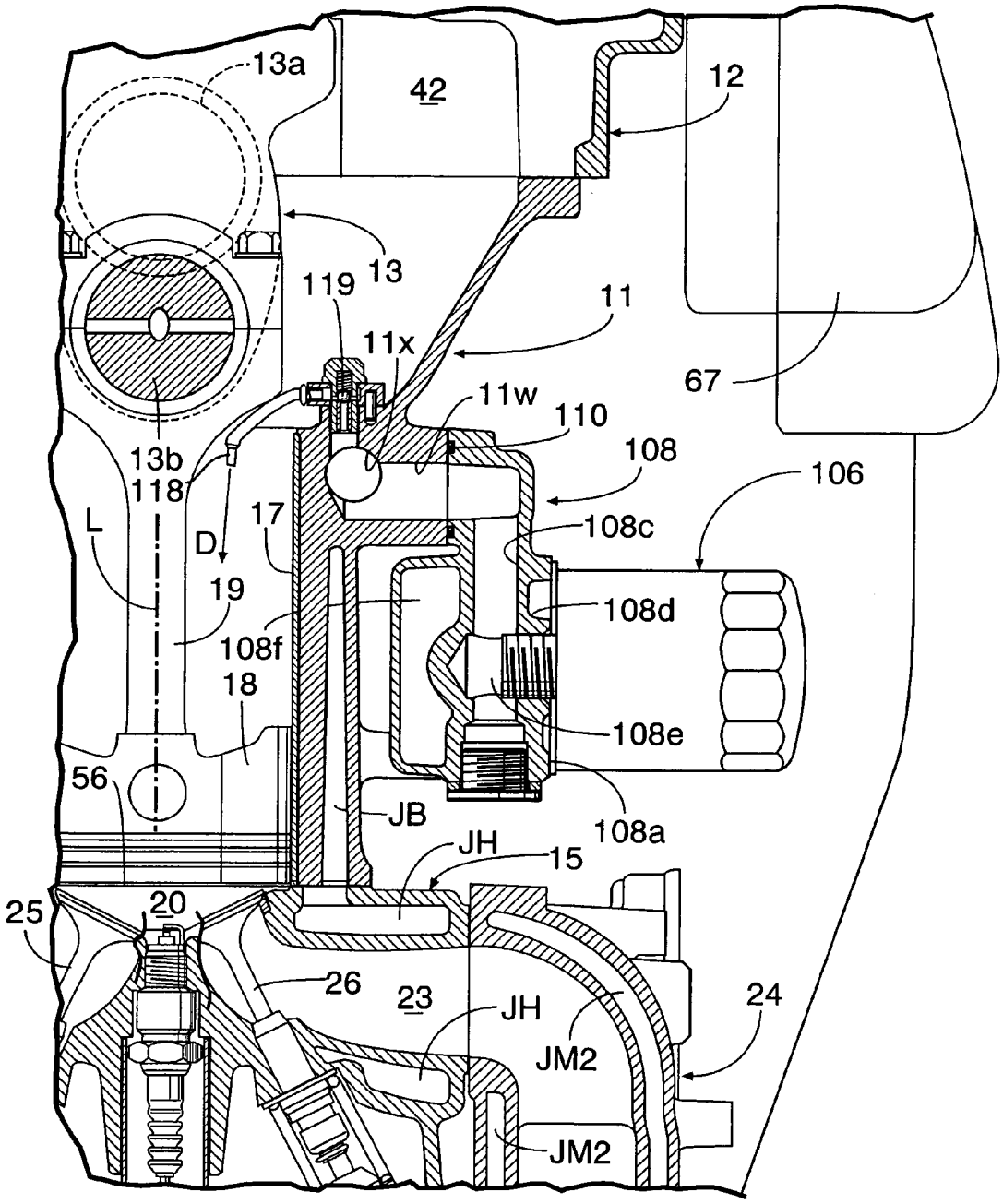
FIG. 20 is an enlarged sectional view taken along a line 20—20 in FIG. 5.

As can be seen from FIGS. 3 and 20, two fourth oil jets 118, 118 are mounted in correspondence to upper two 17, 17 of the four cylinders 17, 17, 17, 17 vertically juxtaposed to have the generally horizontal cylinder axes L. The fourth oil jets 118, 118 are mounted for the purpose of cooling the pistons 18, 18, unlike the first, second and third oil jets 101, 103 and 105 mounted mainly for the purpose of lubrication. If the hydraulic pressure in a main gallery 11*x* extending vertically within the cylinder block 11 exceeds a predetermined value, check valves 119, 119 each receiving a predetermined set load are opened, whereby the fourth oil jets 118, 118 inject the oil in a direction of an arrow D toward rear faces of the piston 18, 18 slidably received in the two cylinders 17, 17.

The structure around an oil filter 106 will be described below with reference to FIGS. 3, 5, 19 and 20.

The oil filter 106 having a cylindrical shape as a whole is mounted on a right side of the cylinder block 11, and screwed into and fixed to a circular oil filter-mounting seat 108*a* of a base member 108 fixed to the cylinder block 11 by five bolts 107. An inlet-side oil supply passage 108*b* and an outlet-side oil supply passage 108*c* are formed within the base member 108. The inlet-side oil supply passage 108*b* communicates at its lower end with an oil supply passage 11*v* in the cylinder block 11 through a seal member 109 and has an oil flow-in portion 108*d* at its upper end, which opens into an outer periphery of the oil filter-mounting seat 108*a*. The outlet-side oil supply passage 108*c* communicates at one end thereof with an oil flow-out portion 108*e* which opens into a central portion of the oil filter-mounting seat 108*a*, and at the other end with the main gallery 11*x* through a seal member 110 and via an oil supply passage 11*w*.

As shown in FIGS. 5 and 7, a coupling 111 is mounted on the upper surface 35U of the mount case 35 to communicate with a source for supplying the cooling water to the relief valve 51, and a cooling-water supply hose 112 extending from the coupling 111 is connected to a coupling 113 at a lower end of the base member 108. A cooling-water discharge hose 115 extending from a coupling 114 mounted at an upper end of the base member 108 is connected to a coupling 71 mounted at an intermediate portion of the draining pipe 88.

A water jacket 108*f* connecting the lower coupling 113 and the upper coupling 114 to each other is provided within the base member 108 and disposed to completely surround the inlet-side oil supply passage 108*b*, and the outlet-side oil supply passage 108*c* and the periphery of the oil filter-mounting seat 108*a* of the base member 108.

The operation of the embodiment of the present invention having the above-described arrangement will be described below.

Figure 22:
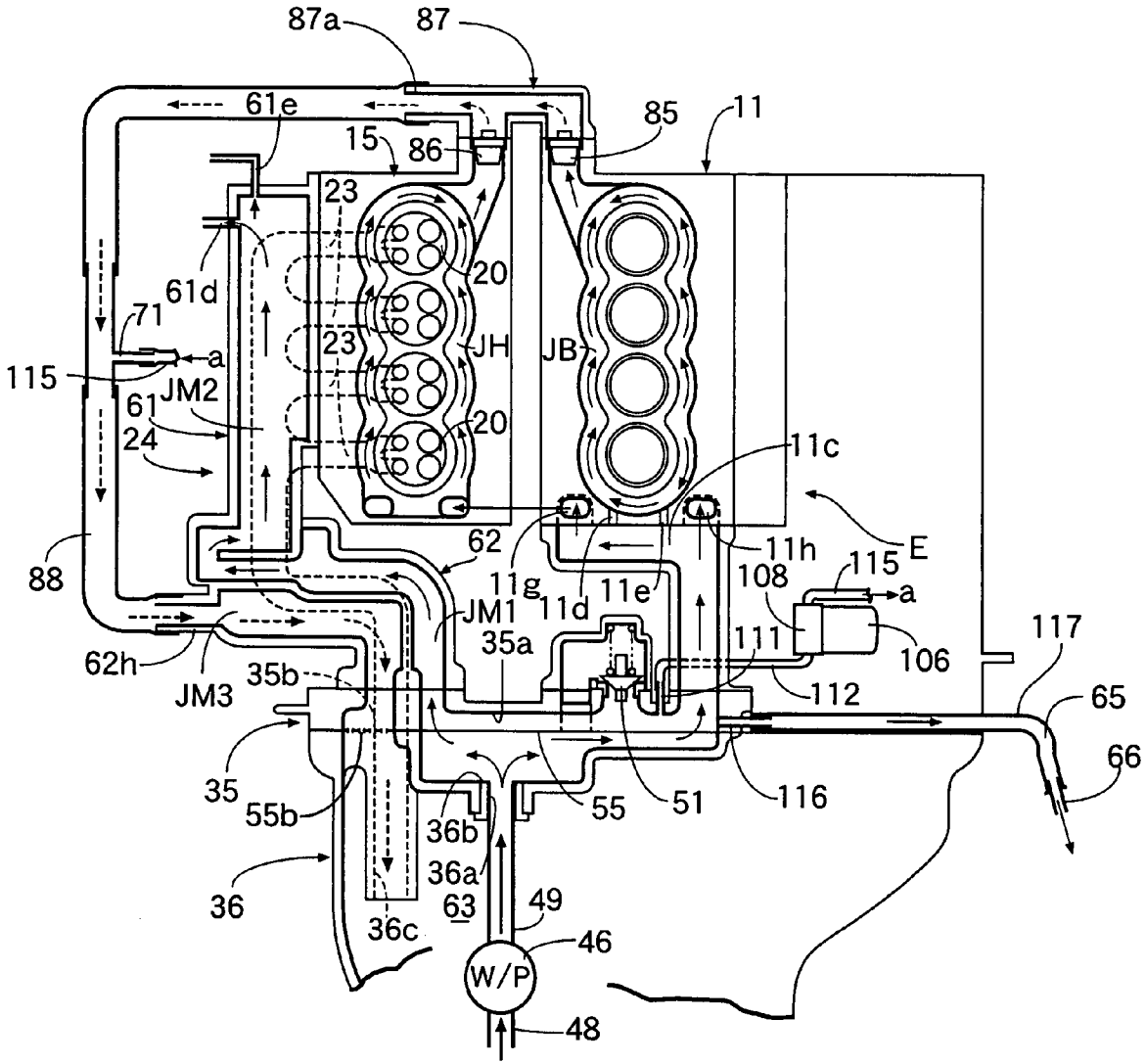
FIG. 22 is a circuit diagram of an engine-cooling system.

First, the operation concerning the cooling of the vertical engine E will be described with reference mainly to a cooling-water circuit in FIG. 22.

When the drive shaft 41 connected to the crankshaft 13 is rotated by the operation of the vertical engine E, the cooling-water pump 46 mounted on the drive shaft 41 is operated to supply the cooling water drawn up through the strainer 47 to the cooling-water supply port 36*a* in the lower surface of the oil case 36 through the lower water supply passage 48 and the upper water supply passage 49. The cooling water passed through the cooling-water supply port 36*a* flows into the cooling-water supply passage 36*b* in the oil case 36 and the cooling-water supply passage 35*a* in the mount case 35, and a portion of the cooling water branched therefrom is supplied to the first exhaust gas guide-cooling water jacket JM1 formed in the exhaust gas guide 62 of the exhaust passage 24 within the engine room and the exhaust manifold-cooling water jacket JM2 formed in the exhaust manifold 61. An exhaust gas discharged from the combustion chambers 20 in the cylinder head 15 is discharged to the exhaust chamber 63 via the single pipe portions 61*a* and the collection portion 61*b* of the exhaust manifold 61, the exhaust passage 62*d* in the exhaust gas guide 62, the exhaust passage 35*b* in the mount case 35 and the exhaust pipe portion 36*c* in the oil case 36, and the exhaust passage 24 within the engine room heated to a higher temperature by the exhaust gas during this process is cooled by the cooling water flowing through the first exhaust gas guide-cooling water jacket JM1 and the exhaust manifold-cooling water jacket JM2.

The cooling water having a high temperature as a result of flowing upward through the first exhaust gas guide-cooling water jacket JM1 and the exhaust manifold-cooling water jacket JM2 is discharged from the couplings 61*d* and 61*e* mounted at the upper end of the exhaust manifold 61 through the pipe line (not shown) to the exhaust chamber 63.

A portion of the cooling water of a lower temperature supplied to the cooling-water supply passages 36*b* and 35*a* connected to the cooling-water supply port 36*a* flows through the two through-bores 11*d* and 11*e* opening into the cooling-water supply passage 11*c* in the lower end of the cylinder block 11 into the lower end of the cylinder block-cooling water jacket JB. The portion of the cooling water of the lower temperature supplied to the cooling-water supply passages 36*b* and 35*a* also flows from the cooling-water supply passage 11*c* in the lower end of the cylinder block 11 via the two cooling-water supply passages 11*g* and 11*h* into the lower end of the cylinder head-cooling water jacket JH.

During the warming operation of the vertical engine E, the first thermostat 85 connected to the upper end of the cylinder block-cooling water jacket JB and the second thermostat 86 connected to the upper end of the cylinder head-cooling water jacket JH are inclosed states, and the cooling water in the cylinder block-cooling water jacket JB and the cylinder head-cooling water jacket JH resides therein without flowing and hence, the warming of the vertical engine E is promoted. During this process, the cooling-water pump 46 is continued to be rotated, but is brought into a substantially racing state by the leakage of the cooling water from a motor impeller made of a rubber.

When the temperature of the cooling water is raised after completion of the warming operation of the vertical engine E, the first and second thermostats 85 and 86 are opened, whereby the cooling water in the cylinder block-cooling water jacket JH and the cooling water in the cylinder head-cooling water jacket JH flow from the common coupling 87*a* of the thermostat cover 87 via the draining pipe 88 and the coupling 62*h* of the exhaust gas guide 62 into the second exhaust gas guide-cooling water jacket JM3. The cooling water which has cooled the exhaust gas guide 62 while flowing through the second exhaust gas guide-cooling water jacket JM3 is passed upward to flow through the mount case 35 and the oil case 36, and discharged into the exhaust chamber 63. When the rotational speed of the vertical engine E is increased to cause the internal pressure in the cooling-water supply passages 36*b* and 35*a* to become equal to or higher than a predetermined value, the relief valve 51 is opened, thereby permitting the surplus cooling water to be discharged into the exhaust chamber 63.

The cooling water diverted from an upstream side of the relief valve 51 into the cooling-water supply hose 112 flows into the lower end of the water jacket 108*f* in the base member 108 of the oil filter 106, and while flowing upwards through the water jacket 108*f*, the cooling water cools the oil flowing through the inlet-side oil supply passage 108*b* and the outlet-side oil supply passage 108*c* formed in the base member 108, and flows through the oil filter-mounting seat 108*a* for the oil filter 106 to cool the oil within the oil filter 106. The cooling water after the heat exchange with the oil is discharged from the upper end of the water jacket 108*f* through the cooling-water discharge hose 115 into an intermediate portion of the draining pipe 88.

Figure 23:
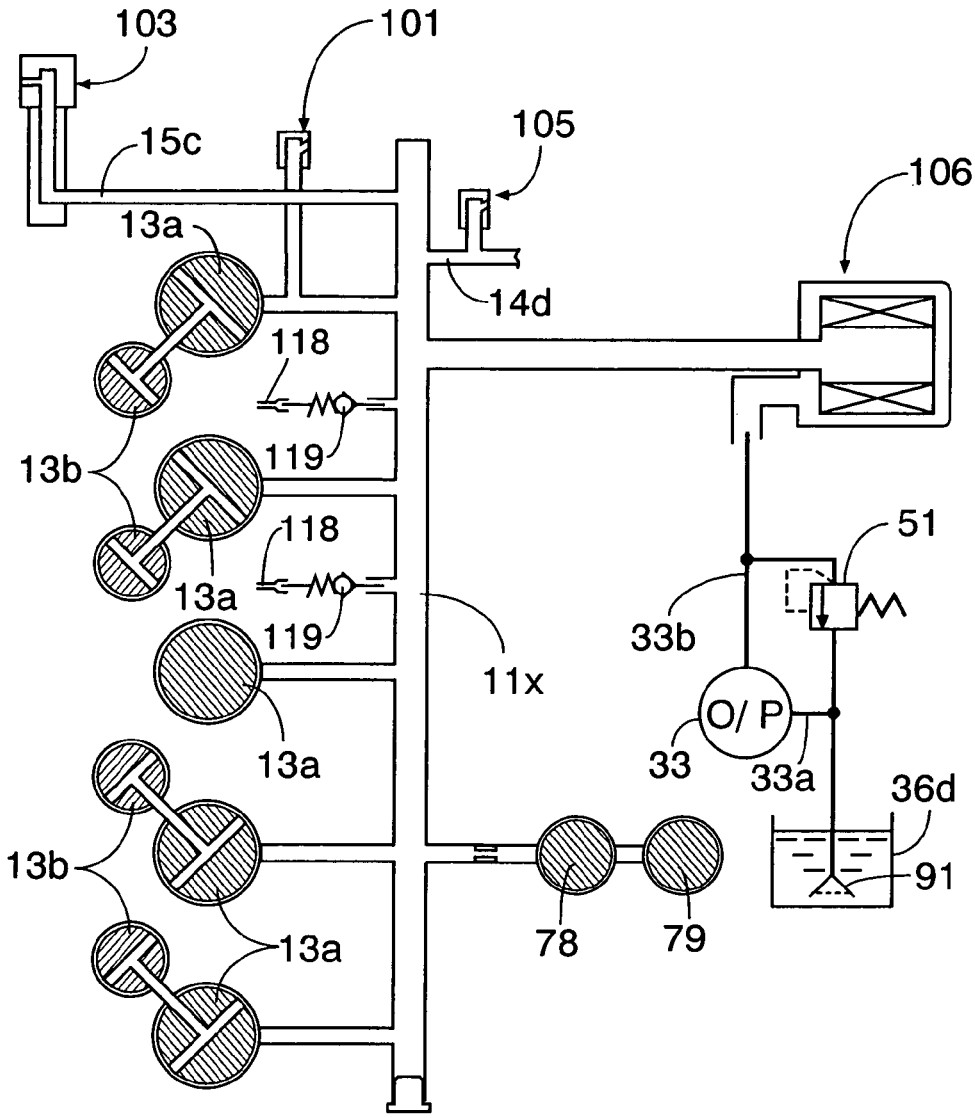
FIG. 23 is a circuit diagram of an engine-lubricating system.

Then operation concerning the lubrication of the vertical engine E will be described below with reference mainly to an oil circuit in FIG. 23.

The oil in the oil pan 36*d* is drawn into the oil pump 33 through the oil strainer 91 and the oil suction passage 33*a* (see FIG. 8), and the oil discharged by the oil pump 33 is supplied from the oil discharge passage 33*b* (see FIG. 8) through the oil passage in the mount case 35 into the oil supply bore 11*m* (see FIG. 9) formed in the lower surface of the cylinder block 11. At this time, the surplus oil discharged by the oil pump 33 is passed through the relief valve 51 and returned to the suction side of the oil pump 33. The relived oil may be returned to the oil pan 36*d*.

The oil supplied to the oil supply passage 11*v* (see FIG. 3) in the cylinder block 11 is supplied therefrom via the inlet-side oil supply passage 108*b* in the base member 108 to the oil filter 106 (see FIGS. 19 and 20), and the oil after being filtered is supplied from the outlet-side oil supply passage 108*c* in the base member 108 via the oil supply passage 11*w* in the cylinder block 11 to the main gallery 11*x* vertically formed in the cylinder block 11. The oil diverted from the main gallery 11*x* lubricates the journals 13*a* and the crankpins 13*b* of the crankshaft 13 and also lubricates the two balancer shafts 78 and 79.

As described above, the base member 108 separate from the cylinder block 11 is formed with the inlet-side oil supply passage 108*b* for supplying the oil to the oil filter 106 and the outlet-side oil supply passage 108*c* for discharging the oil from the oil filter 106. Therefore, it is unnecessary to increase the thickness of the wall of the cylinder block 11 or to form a bulged portion surrounding the oil passages in order to form the outlet-side oil supply passage 108*c* and the inlet-side oil supply passage 108*b*. This can contribute to a reduction in weight of the cylinder block 11. Moreover, because the inlet-side oil supply passage 108*b* and the outlet-side oil supply passage 108*c* are formed in the base member 108, their layouts can be established freely without being restricted to the shape of the cylinder block 11 to contribute an increase in degree of freedom for the design.

In addition, because the water jacket 108*f* facing the inlet-side oil supply passage 108*b*, the outlet-side oil supply passage 108*c* and the oil filter-mounting seat 108*a* are formed in the base member 108 supporting the oil filter 106, the degree of freedom for the layout of the water jacket 108*f* can be increased as compared with a case where the water jacket is formed in the cylinder block 11. Moreover, the lower-temperature cooling water which is not heated and which has just exited from the cooling-water pump 46 is supplied to the water jacket 108*f* and hence, the oil can be cooled effectively by the cooling water flowing through the water jacket 108*f*. As a result, it is possible to enhance the lubricating effect and the cooling effect for portions to be lubricated such as sliding portions of the cylinders 17 and the pistons 18, the crankshaft 13, the camshafts 73, 73, the balancer shafts 78 and 79, the timing chain 30 and the balancer-driving chain 82.

The first oil jet 101 (see FIGS. 13 and 16) is connected to the oil jet support bore 11*t* diverted from the oil supply passage extending from the main gallery 11*x* to the uppermost journal 13*a*; the second oil jet 103 (see FIG. 17) is connected to the oil supply passage 15*c* diverted from the main gallery 11*x*, and the third oil jet 105 (see FIG. 18) is connected to the oil supply passage 14*d* diverted from the main gallery 11*x*.

The nozzle 101*b* of the first oil jet 101 injects the oil to the cam-driving sprocket 72 mounted at the upper end of the crankshaft 13 to lubricate the timing chain 30 reeved around the cam-driving sprocket 72. The balancer-driving sprocket 81 is mounted on the crankshaft 13 so that it is located immediately below the cam-driving sprocket 72, and the oil dropped from the cam-driving sprocket 72 is sprinkled on the balancer-driving sprocket 81 to lubricate the balancer-driving chain 82 reeved around the balancer-driving sprocket 81.

In this way, the cam-driving sprocket 72 and the balancer-driving sprocket 81 are disposed at vertical two stages, and the oil can be injected toward the cam-driving sprocket 72 disposed at the upper stage, whereby the oil colliding with the cam-driving sprocket 72 and dropping therefrom can be brought into contact with the balancer-driving sprocket 81, thereby effectively lubricating both the cam-driving sprocket 72 and the balancer-driving sprocket 81. At this time, the oil dropping from the cam-driving sprocket 72 can be brought further effectively into contact with the balancer-driving sprocket 81, leading to an enhancement in lubricating effect, because the diameter of the balancer-driving sprocket 81 disposed at the lower stage is set to be larger than that of the cam-driving sprocket 72 disposed at the upper stage.

The periphery of the cam-driving sprocket 72 to which the oil is injected from the first oil jet 101 is surrounded by the third and fourth arcuate ribs 31*e* and 31*f* hanging from the ceiling surface of the chain cover 31. Therefore, it is possible to prevent the injected oil from being scattered wastefully, thereby further enhancing the effect of lubricating the cam-driving sprocket 72 and the balancer-driving sprocket 81.

The oil injected from the nozzle 103*b* of the second oil jet 103 points to the position in which the timing chain 30 is meshed into the one cam follower sprocket 74, and moreover, this position is largely spaced apart from a position in which the first oil jet 101 is mounted. Therefore, the entire region of the timing chain 30 can be lubricated equally by cooperation between the first and second oil jets 101 and 103.

The first and second ribs 31*b*and 31*c* hanging from the ceiling surface of the chain case 31 are disposed in proximity to the upper surface of the timing chain 30. Therefore, the oil flowing down from the ceiling surface along the first and second ribs 31*b* and 31*c* is positively supplied to sliding portions between the pins 30*b* and the bores in the plurality of plates 30*a* of the timing chain 30 and sliding portions between the timing chain 30 and the chain guide 76 to lubricate them. Particularly, in the timing chain 30 comprising the silent chain, the plates 30*a* and the sprocket are meshed directly with each other, and a driving force for the chain acts directly on the sliding portions of the bores in the plates 30*a* and the pins 30*b*. However, the wear of the sliding portions can be alleviated by supplying a sufficient amount of the oil to them through the first and second ribs 31*b* and 31*c* to provide the lubricating effect, as described above.

The two recesses 16*d*, 16*d* of the head cover 16 are provided with the horizontal walls 16*c*, 16*c* opposed to the lower surface of the timing chain 30, and hence the dropped oil can be accumulated temporarily on the horizontal walls 16*c*, 16*c* to lubricate the timing chain 30 traveling through the horizontal walls 16*c*, 16*c*. Moreover, the oil can be guided in an entraining direction along an arcuate travel locus of the timing chain 30 by cooperation with the vertical walls 16*b*, 16*b* opposed to the outer peripheral surface of the timing chain 30. Therefore, it is possible to ensure the contact of the oil with the timing chain 30 over a long time and a long distance.

Further, the oil scattered diametrically outwards from the cam follower sprockets 74, 74 by a centrifugal force can be caught on the vertical walls 16*b*, 16*b*, and the oil flowing down along the vertical walls 16*b*, 16*b* can be retained on the horizontal walls 16*c*, 16*c*. Therefore, the oil can be brought effectively into contact with the timing chain 30 circulating at a predetermined distance along the vertical walls 16*b*, 16*b* and the horizontal walls 16*c*, 16*c*, thereby enhancing the lubricating effect. Moreover, because the vertical walls 16*b*, 16*b* and the horizontal walls 16*c*, 16*c* are integrally formed by providing the recesses 16*d*, 16*d* on a portion of the head cover 16, there is no possibility that the number of parts is increased.

The oil injected from the third oil jet 105 points to the position in which the balancer-driving chain 82 is meshed into the balancer follower sprocket 80 and moreover, this position is largely spaced apart from a position in which the first oil jet 101 is mounted. Therefore, the entire region of the balancer-driving chain 82 can be lubricated equally by cooperation between the first and third oil jets 101 and 105.

Because the recess 14*c* of the crankcase 14 is provided with the horizontal wall 14*b* opposed to the lower surface of the balancer-driving chain 82, the dropped oil can be accumulated temporarily on the horizontal wall 14*b* to lubricate the balancer-driving chain 82 passed through the horizontal wall 14*b*. Moreover, the oil can be guided in an entraining direction along an arcuate travel locus of the balancer-driving chain 82 by cooperation with the vertical wall 14*a* opposed to the outer peripheral surface of the balancer-driving chain 82. Therefore, it is possible to ensure the contact of the oil with the balancer-driving chain 82 over a long time and a long distance.

Further, the oil scattered radially outwards from the balancer follower sprocket 80 by a centrifugal force can be caught on the vertical wall 14*a*, and the oil flowing down along the vertical wall 14*a* can be retained on the horizontal walls 14*b*. Therefore, the oil can be brought effectively into contact with the balancer-driving chain 82 circulating at a predetermined distance along the vertical wall 14*a* and the horizontal wall 14*b*, thereby enhancing the lubricating effect. Moreover, because the vertical wall 14*a* and the horizontal wall 14*b* are integrally formed by providing the recess 14*c* on a portion of the crankcase 14, there is no possibility that the number of parts is increased.

In the embodiment, the vertical walls 16*b*, 16*b* and the horizontal walls 16*c*, 16*c* of the head cover 16 are formed integrally and continuously, but they may be formed by members separate from the head cover 16 and fixed to the head cover 16 at any locations. This is advantageous to absorb an error upon the assembling, if there is a slight clearance between each of the vertical walls 16*b*, 16*b* and each of the horizontal walls 16*c*, 16*c*.

Likewise, in the embodiment, the vertical wall 14*a* and the horizontal wall 11*b* of the crankcase 14 are formed integrally and continuously, but they may be formed by members separate from the crankcase 14 and fixed to the crankcase 14 at any locations. This is advantageous to absorb an error upon the assembling, if there is a slight clearance between the vertical wall 14*a* and the horizontal wall 11*b*.

In general, if the timing chain 30 and the balancer-driving chain 82 are disposed at the upper ends of the crankshaft 13, the camshafts 73, 73 and the balancer shaft 79, it is impossible to expect an effect of sufficient lubrication of the timing chain 30 and the balancer-driving chain 82 by only the oil leaked from bearings of these shafts 13, 73, 73 and 79 and for this reason, a reduction in durability of these chains 30 and 82 is feared. Therefore, as in the present embodiment, the oil is injected from the first, second and third oil jets 101, 103 and 105 to the timing chain 30 and the balancer-driving chain 82; the oil scattered to the ceiling surface of the chain case 31 is guided to the timing chain 30 and the balancer-driving chain 82 by the first, second, third and fourth ribs 31*b*, 31*c*, 31*e* and 31*f*; and further, the oil is retained on the vertical walls 14*a*, 16*b*, 16*b* and the horizontal walls 14*b*, 16*c*, 16*c* formed on the crankcase 14 and the head cover 16, respectively, whereby an effect of sufficient lubrication of the timing chain 30 and the balancer-driving chain 82 can be ensured.

The first and second oil jets 101 and 103 are disposed at the opposite ends of the timing chain 30, and the first and third oil jets 101 and 105 are disposed at the opposite ends of the balancer-driving chain 82. Therefore, the oil can be injected equally to the entire regions of the timing chain 30 and the balancer-driving chain 82 to enhance the lubricating effect.

By the provision of the first and second oil jets 101 and 103 inside the travel locus of the timing chain 30, it is easy to dispose the first and second oil jets 101 and 103 within the narrow chain chamber 54. In addition, by the provision of the third oil jet 105 outside the travel locus of the balancer-driving chain 82, the third oil jet 105 can be disposed without hindrance, even when a space cannot be ensured inside such travel locus.

Further, even when the oil cannot be injected horizontally due to the presence of an obstacle, because the directions of injection of the oil from the first and third oil jets 101 and 103 are inclined with respect to the rotational planes of the timing chain 30 and the balancer-driving chain 82, the disposition of the first and third oil jets 101 and 105 cannot be impeded.

If a breather pipe is connected to the chain chamber 54, there is a possibility that the oil injected from each of the first, second and third oil jets 101, 103 and 105 into the chain chamber 54 may clog the breather pipe. In the present embodiment, however, the breather pipe 95 (see FIG. 2) is connected to the inside of the head cover 16 isolated from the chain chamber 54, whereby the breather pipe 95 can be prevented from being clogged with the oil.

The oil which has lubricated the first and second chain mechanisms 80 and 90, namely, the cam-driving sprocket 72, the cam follower sprockets 74, 74, the timing chain 30, the balancer-driving sprocket 81, the balancer follower sprocket 80 and the balancer-driving sprocket 82 in the above described manner is dropped through the oil return bores 11*p*, 11*p* and 11*s* (see FIGS. 3 and 15) formed in the upper surface of the cylinder block 11, and the oil is passed sequentially through the four oil return bores 11*s* (see FIG. 3) formed in the upper second and more journal support walls 11*r* of the cylinder block 11 to be returned to the oil pan 36*d*.

As can be seen from FIG. 15, the bulged portion 11*q* of the uppermost cylinder 17 protrudes on the upper surface of the cylinder block 11, and the left and right oil return bores 11*p*, 11*p* are formed at lowermost locations displaced from the bulged portion 11*q* toward the crankshaft 13. Therefore, the oil on such bulged portion 11*q* flows so that it is distributed to the opposite sides of the axis of the bulged portion 11*q*; and the oil is caught smoothly in the oil return bores 11*p*, 11*p*; and returned to the oil pan 36*d*.

The uppermost oil return bore 11*s* disposed in the upper surface of the cylinder block 11 between the left and right oil return bores 11*p*, 11*p* is not necessarily required. In the present embodiment, the uppermost oil return bore 11*s* is secondarily formed in processing the four oil return bores 11*s* formed in the upper second and more journal support walls 11*r*.

In the process in which the oil injected into the chain chamber 54 is returned through the oil return bores 11*p*, 11*p* and 11*s* provided in the journal support walls 11*r* of the cylinder block 11 to the underlying oil pan 36*d*, the oil passed through the oil return bores 11*s* collides against the connecting rods 19, whereby it is scattered and brought into contact with the connecting rods 19, the pistons 18, the cylinders 17 and the like, to thereby contribute to the cooling the pistons 18 heated to a higher temperature by a heat from the combustion chamber 20. At the same time, the oil scattered by the centrifugal force after lubricating the journals 13*a* and the crankpins 13*b* of the crankshaft 13 is also brought into contact with the connecting rods 19, the pistons 18, the cylinders 17 and the like, to thereby contribute to the cooling of the pistons 18 by cooperation with the oil returned from the chain chamber 54.

The amount of the oil cooling the pistons 18 is larger at a location closer to the lower portion of the cylinder block 11 and hence, there is a tendency that the cooling of the upper piston(s) 18 is insufficient, and the cooling of the lower piston(s) 18 is excessive. In the present embodiment, however, the oil injected from the fourth oil jets 118, 118 mounted at upper two 17, 17 of the four cylinders 17 is brought into contact with the rear faces of the upper two pistons 18, 18 to exhibit a cooling effect, whereby the four pistons 18 can be cooled equally to prevent the occurrence of the insufficient cooling and excessive cooling. Moreover, the amount of the oil required for the cooling can be minimized to a necessary amount.

When the rear faces of the pistons 18, 18 are cooled by the oil injected from the fourth oil jets 118, 118, the temperature of the oil is liable to increase by the heat taken away from the pistons 18, 18. In the present embodiment, however, the rising of the temperature of the oil can be suppressed reliably, because the cooling effect of the oil in the oil filter 106 is extremely high.

Although the embodiment of the present invention has been described in detail, it will be understood that the present invention is not limited to the above-described embodiment, and various modifications in design may be made without departing from the spirit and scope of the invention defined in the claims.

For example, the vertical engine E used in the outboard engine system O has been illustrated in the embodiment, but the present invention is applicable to any vertical engine E not for the outboard engine system O.

The cam follower sprockets 74, 74 and the balancer follower sprocket 80 are mounted at the upper ends of the camshafts 73, 73 and the balancer shaft 79 in the embodiment, but the cam follower sprockets 74, 74 and the balancer follower sprocket 80 maybe mounted at lower ends of the camshafts 73, 73 and the balancer shaft 79 in the embodiment, and the oil guide means including the horizontal walls 14*b* and 16*c* and the vertical walls 14*a* and 16*b* may be provided above the bottom wall of the chain chamber 54 in which the timing chain 30 and the balancer-driving chain 82 are accommodated, as in the case of the fourth feature of the present invention.

If the vertical engine is constructed as described above, when the oil which does not contribute to the lubrication of the timing chain 30 and the balancer-driving chain 82 is discharged from the bottom wall of the chain chamber 54, the oil guide means provided above the bottom wall cannot obstruct the discharge of the oil.

The oil guide means is provided on the crankcase 14 and the head cover 16 in the embodiment, but the oil guide means may be provided on members supporting the camshafts 73, 73 and the balancer shaft 79 as in the case of the seventh feature of the present invention. If the vertical engine is constructed in this way, the positional relationship of the oil guide means to the cam follower sprockets 74 and the balancer follower sprocket 80 mounted on the camshaft 73, 73*a* and the balancer shaft 79 is constant, and hence it is possible to increase the dimensional accuracy of a clearance defined between the timing chain 30 as well as the balancer-driving chain 82 and the oil guide means.

Further, the arcuate third and fourth ribs 31*e* and 31*f* are disposed around the cam-driving sprocket 72 and the balancer-driving sprocket 81 in the embodiment, but the arcuate ribs may be disposed around the cam follower sprockets 74, 74 or the balancer follower sprocket 80, as in the case of the fourteenth feature of the present invention.

What is claimed is:

1. A vertical engine comprising a first shaft disposed in a generally vertical direction, a second shaft disposed in a generally vertical direction and driven by the first shaft, and a chain wound around sprockets mounted on the first and second shafts and circulated in a generally horizontal plane, wherein the vertical engine further includes an oil guide means which is disposed along at least a portion of a circulation locus of the chain and which includes a generally horizontal wall opposed to a lower surface of the chain, and wherein the first and second shafts are provided at their upper ends with the sprockets.

2. A vertical engine according to claim 1, wherein the oil guide means is mounted in a region where the chain is meshed with the sprockets, and the oil guide means includes a vertical wall which rises generally vertically from the horizontal wall and which is opposed to an outer peripheral surface of the chain.

3. A vertical engine according to claim 1, wherein the oil guide means is disposed at a location along the chain meshed with the sprocket on the second shaft and above a bearing of the second shaft.

4. A vertical engine according to claim 1, wherein the oil guide means is formed integrally with a member defining a chain chamber in which the chain is accommodated.

5. A vertical engine according to claim 4, wherein the oil guide means is formed by depressing a portion of the member defining the chain chamber in which the chain is accommodated.

6. A vertical engine according to claim 1, wherein the oil guide means is mounted in a member supporting the first shaft or the second shaft.

7. A vertical engine comprising a first shaft disposed in a generally vertical direction, a second shaft disposed in a generally vertical direction and driven by the first shaft, and a chain wound around sprockets mounted on upper ends of the first and second shafts and circulated in a generally horizontal plane, wherein the vertical engine further includes an oil guide means which is disposed along a region where the chain is meshed with the sprockets, and which includes a generally vertical wall opposed to an outer peripheral surface of the chain.

8. A vertical engine according to any of claims 1–3 and 4–7, further including an oil jet for injecting the oil to the chain, the oil jet being mounted in the chain chamber in which the chain is accommodated.

9. A vertical engine according to any of claims 1–3 and 4–7, wherein the chain is a silent chain.

10. A vertical engine comprising a first shaft disposed in a generally vertical direction, a second shaft disposed in a generally vertical direction and driven by the first shaft, and a chain wound around sprockets mounted on the first and second shafts and circulated in a generally horizontal plane, wherein the vertical engine further includes a rib which is disposed generally along a travel locus of the chain to guide an oil to the chain, and wherein the rib is extended in a direction perpendicular to and toward the travel locus of the chain, from a member defining a chamber for accommodating the chain.

11. A vertical engine according to claim 10, wherein the rib is formed integrally on a lower surface of a cover member as said member covers an upper portion of the chain from above.

12. A vertical engine according to claim 10, further including a chain tensioner or a chain guide disposed along the travel locus of the chain, wherein the rib is provided above the chain tensioner or the chain guide.

13. A vertical engine according to claim 10, wherein the rib is provided sideways of the sprocket mounted on the first shaft or the second shaft.

14. A vertical engine according to claim 10, wherein the chain is wound around the sprockets mounted at upper ends of the first shaft and the second shaft.

15. A vertical engine according to claim 10, wherein the first shaft is a crankshaft, and the second shaft is a camshaft.

16. A vertical engine according to claim 10, wherein the first shaft is a crankshaft, and the second shaft is a balancer-driving shaft.

17. A vertical engine according to any of claims 10 to 16, further including an oil jet for injecting the oil to the chain, the oil jet being mounted in said chamber in which the chain is accommodated.

18. A vertical engine according to any of claims 10 to 16, wherein the chain is a silent chain.

* * * * *